US010203139B2

(12) United States Patent
Kobayashi et al.

(10) Patent No.: US 10,203,139 B2
(45) Date of Patent: Feb. 12, 2019

(54) COOLING DEVICE

(71) Applicant: Samsung Electronics Co., Ltd., Gyeonggi-do (KR)

(72) Inventors: Makoto Kobayashi, Kanagawa (JP); Tomoharu Iwamoto, Kanagawa (JP); Manabu Motegi, Kanagawa (JP); Ryota Aoki, Kanagawa (JP); Isamu Takatsuki, Kanagawa (JP)

(73) Assignee: Samsung Electronics Co., Ltd., Suwon-si (KR)

( * ) Notice: Subject to any disclaimer, the term of this patent is extended or adjusted under 35 U.S.C. 154(b) by 230 days.

(21) Appl. No.: 15/101,401

(22) PCT Filed: Nov. 27, 2014

(86) PCT No.: PCT/KR2014/011506

§ 371 (c)(1),
(2) Date: Jun. 2, 2016

(87) PCT Pub. No.: WO2015/083983

PCT Pub. Date: Jun. 11, 2015

(65) Prior Publication Data

US 2016/0305696 A1 Oct. 20, 2016

(30) Foreign Application Priority Data

Dec. 2, 2013 (JP) ..... 2013-249489
Dec. 5, 2013 (JP) ..... 2013-252046
(Continued)

(51) Int. Cl.
*F25B 49/02* (2006.01)
*F25B 41/04* (2006.01)
(Continued)

(52) U.S. Cl.
CPC ..... *F25B 49/02* (2013.01); *F25B 5/02* (2013.01); *F25B 41/04* (2013.01); *F25B 41/067* (2013.01);
(Continued)

(58) Field of Classification Search
CPC ..... F25B 5/00; F25B 5/02; F25B 5/04; F25B 2600/2511; F25D 11/022
(Continued)

(56) References Cited

U.S. PATENT DOCUMENTS 7,770,406 B2 * 8/2010 Yoshioka ..... F25B 1/10 62/199
2008/0196426 A1 * 8/2008 Taras ..... F24F 3/153 62/173

FOREIGN PATENT DOCUMENTS

JP 2001-133128 5/2001
JP 2006-138583 6/2006
(Continued)

OTHER PUBLICATIONS

International Search Report dated Feb. 26, 2015 in connection with International Application No. PCT/KR2014/011506, 5 pages.
(Continued)

*Primary Examiner* — Marc Norman

(57) ABSTRACT

The present invention provides precise temperature control of a cooling chamber and comprises: a cooling chamber; a refrigeration circuit having a compressor, a condenser installed at the outlet side of the compressor, an evaporator, installed between the outlet side of the condenser and the inlet side of the compressor, for cooling the cooling chamber, and a decompression means installed at the inlet side of the evaporator; and a refrigerant control unit which has a refrigerant control valve installed between the condenser and the evaporator, and which adjusts the refrigerant flow
(Continued)

rate that flows into the evaporator by controlling the opening/closing time of the refrigerant control valve.

20 Claims, 29 Drawing Sheets

(30) Foreign Application Priority Data

Sep. 3, 2014 (JP) ..... 2014-179181
Nov. 27, 2014 (KR) ..... 10-2014-0167248

(51) Int. Cl.
*F25D 11/02* (2006.01)
*F25B 41/06* (2006.01)
*F25B 5/02* (2006.01)
*F25B 47/02* (2006.01)

(52) U.S. Cl.
CPC ..... *F25B 47/02* (2013.01); *F25D 11/022* (2013.01); *F25B 2400/01* (2013.01); *F25B 2600/01* (2013.01); *F25B 2600/2511* (2013.01); *F25B 2700/2104* (2013.01); *F25B 2700/2106* (2013.01)

(58) Field of Classification Search
USPC ..... 62/199, 200, 504
See application file for complete search history.

(56) References Cited

FOREIGN PATENT DOCUMENTS

| | | |
|---|---|---|
| KR | 10-0177709 | 11/1998 |
| KR | 10-2006-0096466 | 9/2006 |
| KR | 10-2007-0101897 | 10/2007 |

OTHER PUBLICATIONS

Written Option of the International Searching Authority dated Feb. 26, 2015 in connection with International Application No. PCT/KR2014/011506, 11 pages.

* cited by examiner

FIG. 11

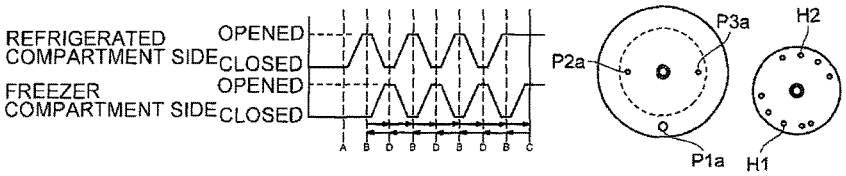

| MODE | ① A | ② B | ③ D |
|---|---|---|---|
| REFRIGERATED COMPARTMENT SIDE | CLOSED | OPENED | CLOSED |
| FREEZER COMPARTMENT SIDE | CLOSED | CLOSED | OPENED |
| POSITIONS OF VALVE SEAT AND VALVE BODY | 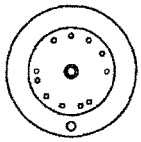 | 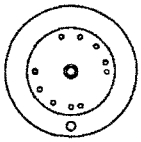 | 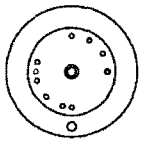 |
| MODE | ④ B | ⑤ D | ⑥ B |
| REFRIGERATED COMPARTMENT SIDE | OPENED | CLOSED | OPENED |
| FREEZER COMPARTMENT SIDE | CLOSED | OPENED | CLOSED |
| POSITIONS OF VALVE SEAT AND VALVE BODY | 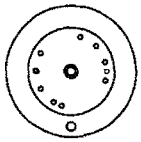 | 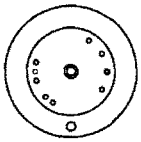 | 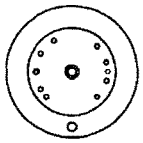 |
| MODE | ⑦ D | ⑧ B | ⑨ C |
| REFRIGERATED COMPARTMENT SIDE | OPENED | CLOSED | OPENED |
| FREEZER COMPARTMENT SIDE | CLOSED | OPENED | OPENED |
| POSITIONS OF VALVE SEAT AND VALVE BODY | 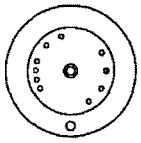 | 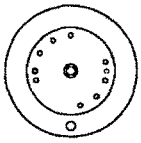 | 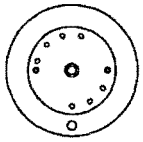 |

FIG. 14

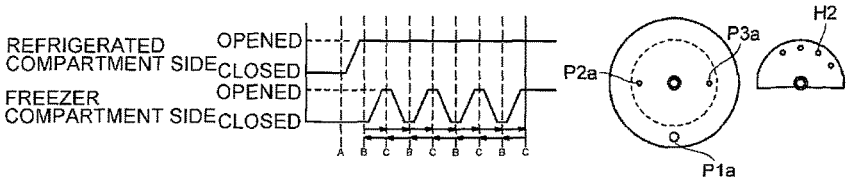

| MODE | ① A | ② B | ③ C |
|---|---|---|---|
| REFRIGERATED COMPARTMENT SIDE | CLOSED | OPENED | OPENED |
| FREEZER COMPARTMENT SIDE | CLOSED | CLOSED | OPENED |
| POSITIONS OF VALVE SEAT AND VALVE BODY | 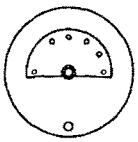 | 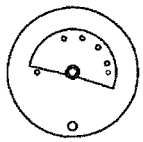 | 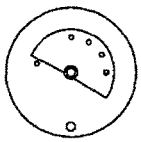 |
| MODE | ④ B | ⑤ C | ⑥ B |
| REFRIGERATED COMPARTMENT SIDE | OPENED | OPENED | OPENED |
| FREEZER COMPARTMENT SIDE | CLOSED | OPENED | CLOSED |
| POSITIONS OF VALVE SEAT AND VALVE BODY | 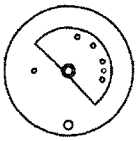 | 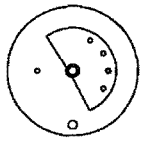 | 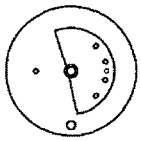 |
| MODE | ⑦ C | ⑧ B | ⑨ C |
| REFRIGERATED COMPARTMENT SIDE | OPENED | CLOSED | OPENED |
| FREEZER COMPARTMENT SIDE | OPENED | OPENED | OPENED |
| POSITIONS OF VALVE SEAT AND VALVE BODY | 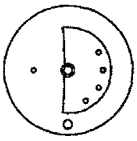 | 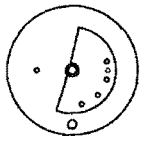 | 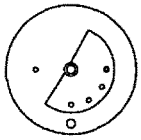 |

FIG. 18
| OUTLET OF REFRIGERATED COMPARTMENT SIDE | FULLY OPENED | ADJUSTMENT | FULLY CLOSED |
|---|---|---|---|
| OUTLET OF FREEZER COMPARTMENT SIDE | FULLY CLOSED | ADJUSTMENT | FULLY OPENED |
| POSITION OF EACH VALVE SEAT | 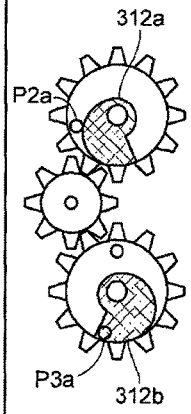  | 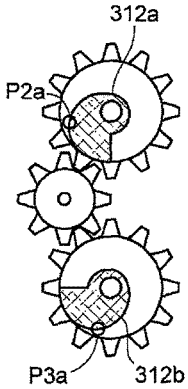  | 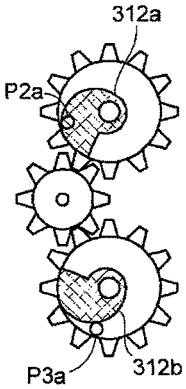  |

FIG. 20
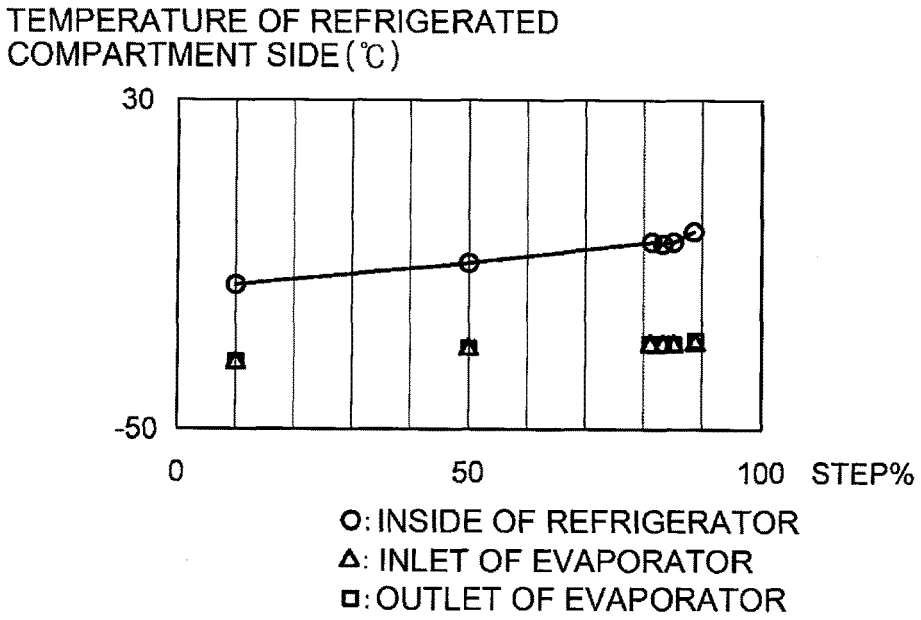
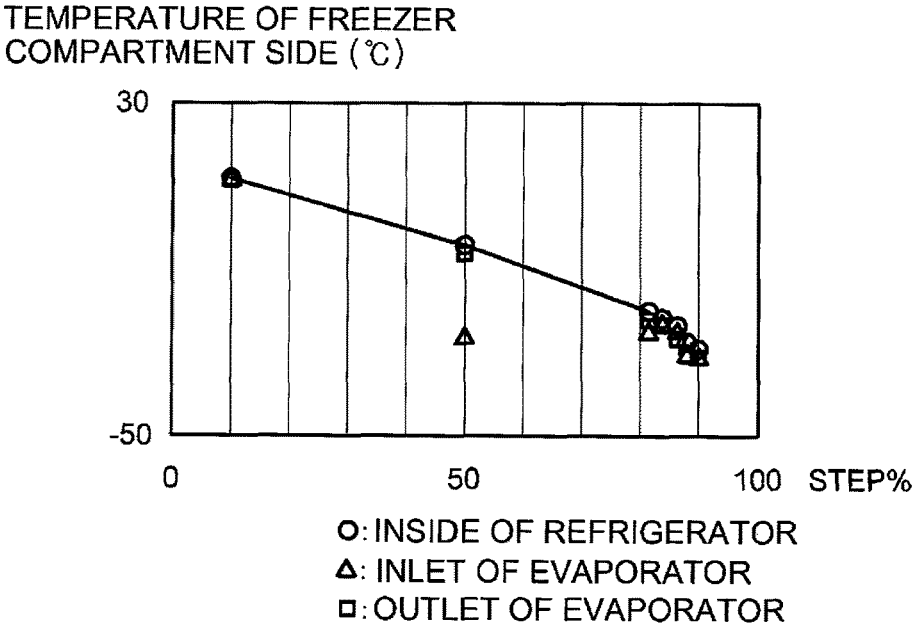

FIG. 22
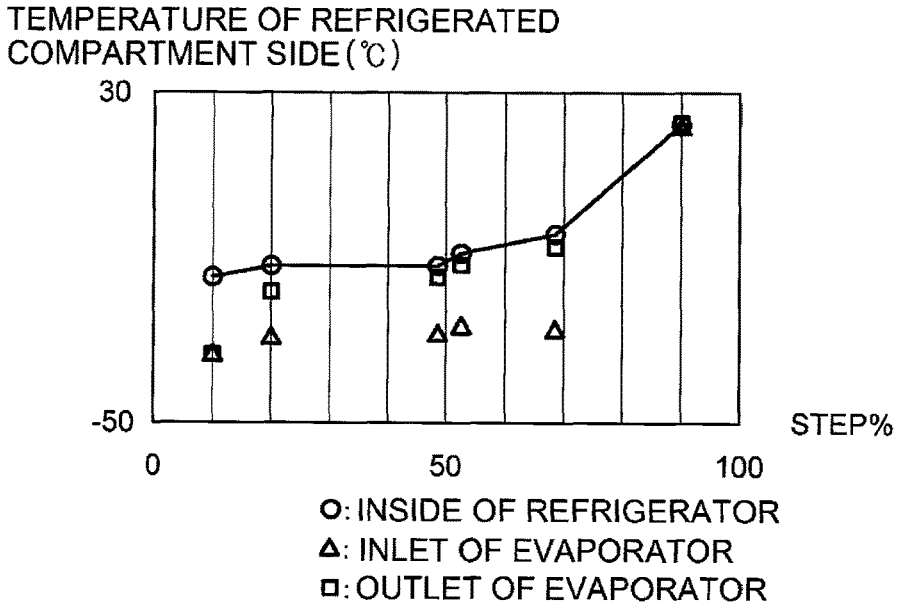
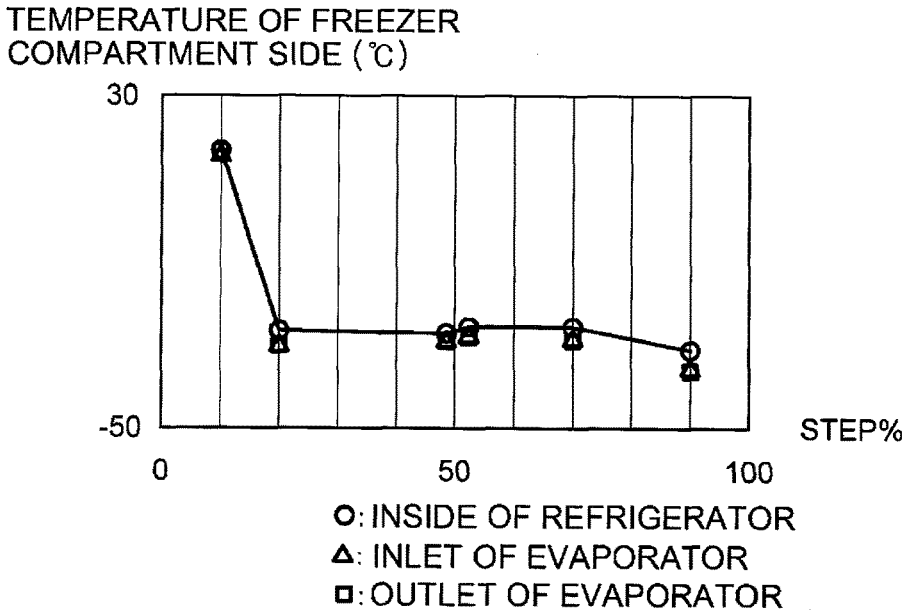

COOLING DEVICE

CROSS-REFERENCE TO RELATED APPLICATION(S)

The present application claims priority under 35 U.S.C. § 365 to International Patent Application No. PCT/KR2014/011506 filed Nov. 27, 2014, entitled "COOLING DEVICE", and, through International Patent Application No. PCT/KR2014/0111506, to Japanese Patent Application No. 2013-249489 filed Dec. 2, 2013, Japanese Application No. 2013-252046 filed Dec. 5, 2013, Japanese Application No. 2014-179181 filed Sep. 3, 2014, and Korean Patent Application No. 10-2014-0167248 filed Nov. 27, 2014, each of which are incorporated herein by reference into the present disclosure as if fully set forth herein.

TECHNICAL FIELD

The present invention relates to a control method of controlling a refrigerant flow rate that flows in a cooling cycle of a cooling device, and a control program.

BACKGROUND ART

Conventionally, as disclosed in Patent Document 1, a cooling device cools an inside of a refrigerator by switching between a refrigerated compartment cooling operation of flowing a refrigerant to a refrigerated compartment evaporator and a freezer compartment cooling operation of flowing the refrigerant only to a freezer compartment evaporator with a 3-way valve to cool both the refrigerated compartment and the freezer compartment with an evaporator at an appropriate evaporation temperature. The cooling device initially determines a time ratio of the refrigerated compartment cooling operation to the freezer compartment cooling operation and switches between the refrigerated compartment cooling operation and the freezer compartment cooling operation depending on the initially determined time ratio.

However, in the cooling device configured as described above, there is a problem in which a refrigerant gathers in the freezer compartment evaporator and a refrigeration circuit in which the corresponding freezer compartment evaporator is installed by selectively performing one of the refrigerated compartment cooling operation and the freezer compartment cooling operation, for example, when the refrigerated compartment cooling operation is performed. Also, there are other problems in that a variable capacity compressor taking action by initially setting the time ratio of the refrigerated compartment cooling operation to the freezer compartment cooling operation and adjusting the number of compressor rotations according to a change in a load is needed and a response to the change in the load is not good enough.

Also, as disclosed in Patent Document 2, although a cooling device may cool both the refrigerated compartment and the freezer compartment when switching between the refrigerated compartment cooling operation and the freezer compartment cooling operation, the cooling device may efficiently perform an energy-saving operation by collecting a refrigerant when the operation is switched, but is not able to solve the above-described problem in the Patent Document 1.

PRIOR ART DOCUMENT

Patent Document

[Patent Document 1] Japanese Patent Application Laid-Open No. H11-304328

[Patent Document 2] Japanese Patent Application Laid-Open No. 2011-12885

[Patent Document 3] Japanese Patent Application Laid-Open No. 2000-346526

[Patent Document 4] Japanese Patent Application Laid-Open No. 2001-343077

[Patent Document 5] Japanese Patent Application Laid-Open No. 2005-214504

[Patent Document 6] Japanese Patent Application Laid-Open No. 2006-138583

DISCLOSURE

Technical Problem

The present invention is directed to providing a cooling device capable of precisely controlling the temperature of a cooling chamber with an excellent response depending on a cooling chamber load or a change in the cooling chamber load.

Technical Solution

One aspect of the present invention provides a cooling device that includes a cooling chamber, a refrigeration circuit that includes a compressor, a condenser installed at an outlet side of the compressor, evaporators installed between an outlet side of the condenser and an inlet side of the compressor to cool a cooling chamber, and a decompression means installed at an inlet side of the evaporator, and a refrigerant control unit that includes a refrigerant control valve installed between the condenser and the evaporator and controls an opening and closing time of the refrigerant control valve to adjust a refrigerant flow rate that flows to the evaporators.

The cooling device may control the refrigerant flow rate that flows to the evaporator by controlling the opening and closing time of the refrigerant control valve, thereby precisely controlling a temperature of the cooling chamber with an excellent response depending on a load of the cooling chamber or a change in the load. Also, the cooling device may reduce power consumption by controlling the refrigeration circuit such as controlling overheating of the evaporator. In addition, since it is difficult to control an opening degree of a valve in the cooling device with a low refrigerant flow rate, in the present invention, the cooling device may easily and precisely control the refrigerant flow rate by controlling the opening and closing time of the refrigerant control valve.

Another aspect of the present invention provides a cooling device that includes a plurality of cooling chambers having temperatures different from each other, a refrigeration circuit including a compressor, a condenser installed at an outlet side of the compressor, a plurality of evaporators connected in parallel between an outlet side of the condenser and an inlet side of the compressor and respectively installed to correspond to the plurality of cooling chambers, and a plurality of decompression means respectively installed at inlet sides of the evaporators, and a refrigerant control unit including a refrigerant control valve installed between the condenser and the plurality of evaporators to control a refrigerant flow rate that flows into each of the evaporators and individually controlling a ratio of the refrigerant that flows into the evaporators by controlling an opening and closing time of the refrigerant control valve during a simultaneous cooling operation of simultaneously cooling the plurality of cooling chambers.

Since the simultaneous cooling operation of simultaneously cooling the plurality of cooling chambers is performed so that all evaporators perform a cooling operation, it is difficult for the refrigerant to gather in a corresponding evaporator. Also, since the opening and closing time of the refrigerant control valve is controlled in the simultaneous cooling operation, a division ratio of the refrigerants (the refrigerant flow rate of each of the evaporators) may be responsively controlled, and a temperature of the cooling chamber may be precisely controlled with an excellent response. Also, power consumption may be reduced by the control of the refrigeration circuit, such as a control of overheating of the evaporator. In addition, since it is difficult to control an opening degree of a valve in the cooling device with a low refrigerant flow rate, in the present invention, the cooling device may easily and precisely control the refrigerant flow rate by controlling the opening and closing time of the refrigerant control valve.

It is preferable that the refrigerant control unit, as a specific embodiment for performing cooling corresponding to the plurality of cooling chambers with different cooling temperatures, alternately performs a refrigerant full outflow period in which the refrigerant flows to all of the plurality of evaporators and a refrigerant partial outflow period in which the refrigerant flows to some of the plurality of evaporators by controlling the opening and closing time of the refrigerant control valve.

Also, in the cooling device including the condenser installed at the outlet side of the compressor, the plurality of evaporators connected in parallel between the outlet side of the condenser and the inlet side of the compressor and respectively installed to correspond to the plurality of cooling chambers, and the plurality of decompression means respectively installed at the inlet sides of the evaporators, and the refrigerant control valve installed between the condenser and the plurality of evaporators and allowing the refrigerants to flow to the evaporators, generally, when one cooling chamber performs a cooling operation, the other cooling chamber stops the cooling operation. Since the refrigerant is selected and remains in the other cooling chamber that stops the cooling operation when the cooling chambers are alternately operated, the amount of the remaining refrigerant is added and charged to the cooling cycle. Because of this, in Patent Document 3, to avoid the problem, it is studied that the flow of the refrigerant may be easily switched by performing a duty control only during a mutual alternating operation.

The refrigerant with the amount enough not to back-flow is supplied to the evaporators during the cooling operation so that the evaporators efficiently function, and a ratio of the liquid refrigerant in the evaporators is high, wherein the liquid refrigerant degrades the flow of an evaporated gaseous refrigerant, and thus a pressure loss is generated. Therefore, the evaporator has a pressure higher than a suction pressure of the compressor and has an evaporation temperature increased as much as the increased pressure. As a result of that, efficiency is degraded due to a degradation of a heat exchange performance of the evaporator.

Also, when the evaporator of one of cooling chambers performs cooling while the evaporator of the other cooling chamber performs defrosting, most of the refrigerant is collected from the evaporator in which the defrosting is being performed, and thus the evaporator of the other cooling chamber performs the cooling operation while the refrigerant is in excess by as much as the added refrigerant. When the cooling operation of the evaporator of the other cooling chamber is performed in the number of compressor rotations during the mutual alternating operation, the evaporator pressure is increased due to the excess refrigerant and the cooling operation is performed for a longer time, which leads to an increase in power consumption. Also, when the cooling operation is performed with an increased rotation number of the compressor at the time of the mutual alternating operation, the evaporation temperature and the cooling operation become optimal, but the pressure is increased due to an increase in the number of compressor rotations, which leads to an increase in power consumption.

Still another aspect of the present invention provides a cooling device that includes a plurality of cooling chambers having temperatures different from each other, a refrigeration circuit including a compressor, a condenser installed at an outlet side of the compressor, a plurality of evaporators connected in parallel between an outlet side of the condenser and an inlet side of the compressor and respectively installed to correspond to the plurality of cooling chambers, and a plurality of decompression means respectively installed at the inlet sides of the evaporators, and a refrigerant control unit including a refrigerant control valve installed between the condenser and the plurality of evaporators to selectively switch an evaporator supplying the refrigerant among the plurality of evaporators, wherein the refrigerant control unit controls a refrigerant flow rate that flows to the evaporators after switching the evaporators supplying the refrigerant by controlling an opening and closing time of the refrigerant control valve. That is, the refrigerant control unit turns the refrigerant control valve ON/OFF after switching the evaporators supplying the refrigerant to intermittently supply the refrigerant.

As is apparent from the above description, the cooling device intermittently supplies the refrigerant after switching the evaporators supplying the refrigerant by controlling the opening and closing time of the refrigerant control valve and controls the refrigerant flow rates that flow to the evaporators, thereby reducing a pressure loss generated due to a liquid refrigerant in a corresponding evaporator and suppressing an increase in an evaporation temperature. Therefore, the cooling device may prevent a heat exchange performance of the evaporator from being degraded, prevent a cooling efficiency from being degraded, and save energy. Also, since a problem in which the refrigerant of the evaporator supplying the refrigerant is oversupplied is resolved, the possibility of a liquid back-flow of the compressor may be reduced, and the durability of the compressor is improved.

Still another aspect of the present invention provides a cooling device that includes a plurality of cooling chambers having temperatures different from each other, a refrigerant circuit including a compressor, a condenser installed at an outlet side of the compressor, a plurality of evaporators connected in parallel between an outlet side of the condenser and an inlet side of the compressor and respectively installed to correspond to the plurality of cooling chambers, and a plurality of decompression means respectively installed at the inlet sides of the evaporators, a refrigerant control unit including a refrigerant control valve which is installed between the condenser and the plurality of evaporators and selectively switches an evaporator supplying a refrigerant among the plurality of evaporators, and a defroster for removing frost from any one of the plurality of evaporators, wherein the refrigerant control unit controls a refrigerant flow rate that flows to an evaporator from which the frost is not removed while frost is removed from any one of the plurality of evaporators by the defroster by controlling an opening and closing time of the refrigerant control valve.

That is, the refrigerant control unit intermittently supplies the refrigerant to the evaporator from which the frost is not removed by turning the refrigerant control valve ON/OFF.

The evaporator from which the frost is removed by the defroster may collect most of the refrigerant remaining in the corresponding evaporator since a temperature is increased by the defroster. Because of this, the amount of the refrigerant in the evaporator to which the refrigerant is supplied by the refrigerant control unit becomes excessive. Therefore, as described above, when a ratio of a liquid refrigerant in the corresponding evaporator is increased, a pressure loss is generated, an evaporator temperature is increased, and a heat exchange performance of the evaporator is degraded, and thus a cooling efficiency is degraded. In the present invention, since the refrigerant control unit controls the opening and closing time of the refrigerant control valve while frost is removed from one of the plurality of evaporators by the defroster to intermittently supply the refrigerant to the evaporators from which the frost is not removed and controls the the refrigerant flow rate, a pressure loss generated due to the liquid refrigerant in the corresponding evaporator is reduced to suppress an increase in the refrigerant flow rate. Therefore, the degradation of the heat exchanging performance of the evaporator and the degradation of cooling efficiency are prevented, and an energy saving operation is performed. Also, since a refrigerant oversupply of the evaporator supplying the refrigerant is resolved, the possibility of a liquid back-flow of the compressor is reduced, and the durability of the compressor is improved.

Specifically, the refrigerant control unit preferably controls a fully opened time and a fully closed time of the refrigerant control valve to easily and precisely control the refrigerant flow rate. That is, the refrigerant control unit preferably performs a duty control on the refrigerant control valve to easily and precisely control the refrigerant flow rate.

Specifically, a cycle of the duty control (a switching cycle between the fully opened time and the fully closed time) may be preferably set from 3 to 200 seconds. In this case, since a liquid refrigerant collecting time may not be secured in the evaporator when the cycle is less than 3 seconds, the liquid refrigerant collection is insufficient. When the cycle is long such as greater than 200 seconds, the amount of the refrigerant supplied to the evaporator is lacking, and thus a cooling efficiency is degraded. Particularly, the cycle of the duty control may be preferably set from 10 to 180 seconds.

To certainly collect liquid refrigerant from the evaporator supplying the refrigerant, it is preferable that an ON time of the refrigerant control valve be set to be longer than an OFF time thereof in the duty control. Also, although the refrigerant control valve is not duty controlled, the OFF time is preferably set to be longer than ON time in a refrigerant control valve operation.

It is preferable that a duty ratio is set to enable a difference between an inlet temperature of the evaporator and an outlet temperature thereof to be uniform in the duty control. That is, it is preferable that the time ratio of the fully opened time to the fully closed time varies. The time ratio may be appropriately determined, for example, so that the temperature difference between the inlet and the outlet of a predetermined evaporator may be overheating-controlled from 0→ to 10→.

Also, it is preferable that the refrigerant control unit varies the time ratio of the ON time to the OFF time of the refrigerant control valve depending on an ambient temperature. When the ambient temperature is high, an excess rate of the refrigerant supplied to the evaporator is low, and when the ambient temperature is low, the excess rate of the refrigerant supplied to the evaporator is high, and thus the time ratio preferably varies depending on the ambient temperature.

Also, a conventional refrigerant control valve is freely opened or closed and switched in a plurality directions, for example, switched between a chilling circulation cycle and a freezing circulation cycle of the cooling device, but four modes including mode a "closed-closed", mode b "opened-closed", mode c "opened-opened", and mode d "closed-opened" are each performed only once during one stroke of the refrigerant control valve. (see FIG. 29)

Conventionally, mode a "closed-closed," which is used when the cooling device stops, comes at a first position of the stroke, and a stroke position is initialized at mode a "closed-closed". A cooling device operation by the conventional refrigerant control valve is controlled in the order of mode a "closed-closed" (stopping)→mode b "opened-closed" (starting an operation)→mode c "opened-opened" (starting a switching)→mode d "closed-opened" (finishing the switching)→returns to a stopping standby state, and then mode c "opened-opened" →mode b "opened-closed" →mode a "closed-closed" (stopping), and the stroke is reciprocated once. Also, mode b "opened-closed" is a chilling circulation cycle in which the refrigerant flows to a refrigerated compartment side. Mode d "closed-opened" is a freezing circulation cycle in which the refrigerant flows to a freezer compartment side.

Also, when an operation (an operation of claim 1) is performed by the conventional refrigerant control valve, after a routine (b⇔c⇔d), such as mode a "closed-closed" (stopping)→mode b "opened-closed" (starting an operation)→mode c "opened-opened" (starting a switching)→mode d "closed-opened" (finishing the switching)→mode c "opened-opened" (starting a switching)→mode b "opened-closed" (finishing the switching), is repeated, the mode is switched to mode a "closed-closed" (stopping). When the refrigerated compartment side or the freezer compartment side is selectively opened or closed, the control valve repeatedly moves between the mode b and the mode d. Therefore, since the cooling device repeatedly reciprocates in the same place during the operation thereof, it is disadvantageous for durability. Also, since the cooling device reciprocates is approximately a half of a control range, a movement time is long, and it is difficult to precisely control the temperature of a refrigerated compartment side evaporator or a freezer compartment side evaporator.

Also, when the refrigerant flow rate of each of the evaporators is performed while the refrigerant simultaneously flows to the refrigerated compartment side and the freezer compartment side, the control cannot be performed in mode c "opened-opened" since a deviation is generated due to a pressure difference, and it is preferable that the flow rate at a time ratio of mode b "opened-closed" to mode d "closed-opened" be controlled by repeating the modes in a short time and intermittently opening and closing the valve. However, in the specification, since the control is repeated in the same portion when a movement distance between the modes is long and it is impossible to repeat the modes in a short time, it is disadvantageous in terms of durability (see Patent Document 4).

Therefore, it is preferable that the refrigerant control valve repeats the opening and closing routine in which a plurality of opening and closing selective modes (an opening and closing state) that are formed of a combination of the opened valve state in which the refrigerant flows to each of the plurality of evaporators and a closed valve state in which the refrigerant does not flow thereto are sequentially switched several times during an one stroke operation of the valve body. Therefore, the refrigerant control valve includes a plurality of the same opening and closing routines during one stroke of the valve body and may reduce the number of reciprocations by reciprocating in the same space, thereby improving the durability of the refrigerant control valve. Also, the refrigerant control valve has the plurality of the same opening and closing routines during one stroke of the valve body to shorten a movement distance between the opening and closing selective modes and reduce the movement time, thereby precisely controlling the temperatures of the plurality of cooling chambers.

Also, it is preferable that the cooling device according to one aspect of the present invention includes at least one check valve installed between the evaporator and the compressor to prevent a back-flow of the refrigerant. And thus a back-flow of the refrigerant generated due to the temperature difference between the evaporators may be prevented and the refrigeration circuit may be easily operated.

Another conventional control valve switches the evaporator to any one of the evaporators installed on the outlet side or controls the flow rate in one direction when the refrigerant simultaneously flows to the plurality of evaporators, wherein a flow rate adjustment is not performed in a continuously varying manner but is just an opening degree ratio (a control point) of various points. Also, in Patent Documents 5 and 6, a flow rate control is performed as a refrigerant flow rate control function by having an arc-shaped control groove from one outlet toward another outlet. But, these control methods may not simultaneously control the refrigerant flow rate in the continuously varying manner.

Still another aspect of the present invention provides a cooling device that includes a plurality of cooling chambers having temperatures different from each other, a refrigerant circuit that includes a compressor, a condenser installed at an outlet side of the compressor, a plurality of evaporators connected in parallel between an outlet side of the condenser and an inlet side of the compressor and respectively installed to correspond to the plurality of cooling chambers, and a plurality of decompression means respectively installed at inlet sides of the evaporators, and a refrigerant control unit including a refrigerant control valve installed between the condenser and the plurality of evaporators to control a refrigerant flow rate that flows into each of the evaporators and continuously and simultaneously changes the refrigerant flow rate that flows to the plurality of the evaporators.

As is apparent from the above description, the refrigerant unit may extend a combination pattern of a flow rate ratio by continuously and simultaneously changing the refrigerant flow rate that flows to the plurality of evaporators. Therefore, since the evaporator temperature in each evaporator may be arbitrarily controlled, the flow rate may be precisely controlled to correspond to the loads of the plurality of cooling chambers. Also, the cooling efficiency of the compressor is increased to reduce power consumption.

It is preferable that the refrigerant control unit changes the refrigerant flow rate that flows to each of the plurality of evaporators at other different change ratios to be particular to the refrigerant flow rate that flows to the plurality of evaporators depending on the load of each cooling chamber corresponding to each evaporator.

As the specific embodiment of the refrigerant control valve, the refrigerant control valve preferably includes a valve main body having an input port connected with the outlet side of the compressor and a plurality of output ports respectively connected to the inlet sides of the plurality of evaporators, and a valve body installed to correspond to each of the plurality of output ports in the valve main body and opening and closing the outlet connected with the output port.

In this case, the refrigerant flow rate of each of the evaporators is not equal to an opening degree ratio of the outlets of the plurality of output ports due to a temperature (a pressure) difference of the evaporators. Because of this, since an evaporator that should adjust the refrigerant flow rate to be less is necessarily needed, it is preferable that the total of outlet opening degrees in the plurality of output ports should not be 100%. For example, when the refrigerant flow rate of one evaporator among two evaporators is set to 70% and the refrigerant flow rate of the other evaporator is set to 30%, although the outlet opening degree of one evaporator is set to 70% and the outlet opening degree of the other evaporator is set to 30%, more than 70% of the refrigerant flow rate of the one evaporator may be outflowing. In this case, the sum of the opening degrees of the outlets is not 100%, for example, the outlet opening degree of the one evaporator is 70% and the outlet opening degree of the other evaporator is 40%.

Also, it is preferable that the refrigerant control unit continuously changes the outlet opening degree in the plurality of output ports depending on a change in the load of each of the evaporators.

Advantageous Effects

According to the proposed cooling device, the temperature of a cooling chamber can be precisely controlled with an excellent response depending on loads of a plurality of cooling chambers and a change in the loads.

DESCRIPTION OF DRAWINGS

FIG. 11 is a view illustrating a location of the valve body in each mode of the refrigerant control valve according to the second embodiment.

FIG. 14 is a view illustrating a location of the valve body in each mode of the refrigerant control valve in the modification of the second embodiment.

FIG. 18 is a view illustrating an operation pattern of the refrigerant control valve of the third embodiment.

FIG. 20 is a view illustrating a temperature distribution according to the third embodiment.

FIG. 22 is a view illustrating a temperature distribution according to the modification of the third embodiment.

MODES OF THE INVENTION

First Embodiment

Hereinafter, a first embodiment of the present invention will be described with reference to the drawings.

Figure 1:
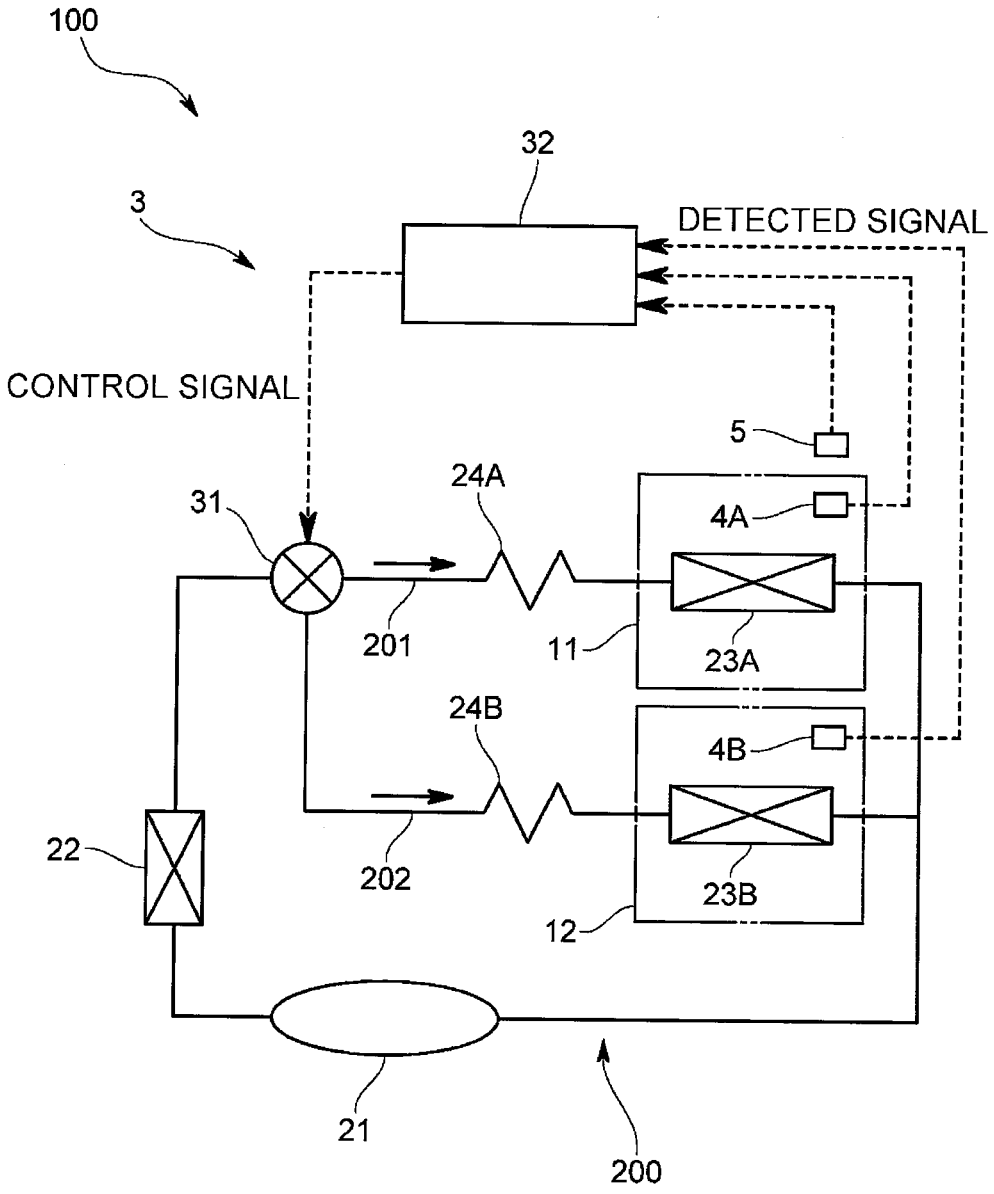
FIG. 1 is a schematic configuration diagram of a cooling device according to a first embodiment.

A cooling device 100 according to the first embodiment, as shown in FIG. 1, is a refrigerator including a refrigerated compartment 11 and a freezer compartment 12, and includes a refrigeration circuit 200 including a compressor 21, a condenser 22 installed at an outlet side of the compressor 21, a refrigerated compartment evaporator 23A and a freezer compartment evaporator 23B installed between the outlet side of the condenser 22 and an inlet side of the compressor 21 and connected with each other in parallel, and a refrigerated compartment decompression means 24A, for example a capillary tube, installed in series at an inlet side of the refrigerated compartment evaporator 23A and a freezer compartment decompression means 24B, for example a capillary tube, installed in series at an inlet side of the freezer compartment evaporator 23B.

In this case, the refrigerated compartment evaporator 23A and the freezer compartment evaporator 23B are respectively installed in two refrigerant branching passages 201 and 202 branched from the outlet side of the condenser 22. The refrigerated compartment evaporator 23A is installed to cool the inside of the refrigerated compartment 11, and the freezer compartment evaporator 23B is installed to cool the inside of the freezer compartment 12.

The cooling device 100 of the embodiment, as shown in FIG. 1, includes a refrigerant control unit 3 individually controlling a refrigerant flow rate flowing to the refrigerated compartment evaporator 23A and the freezer compartment evaporator 23B by adjusting the refrigerant flow rate that flows into each of the refrigerant branching passages 201 and 202.

The refrigerant control unit 3 includes a refrigerant control valve 31 that controls the refrigerant flow rate that flows into the refrigerated compartment evaporator 23A and the freezer compartment evaporator 23B and a control device 32 that controls the corresponding refrigerant control valve 31. The control device 32 is a general or exclusive computer including a central processing unit (CPU), a memory, an input output interface, an analog to digital (AD) converter and the like, and controls the refrigerant control valve 31 by enabling the CPU, peripherals and the like to cooperate with each other according to a control program stored in a predetermined area of the memory.

The refrigerant control valve 31 of the embodiment is a 3-way valve installed at a branching point of the refrigerant branching passages 201 and 202. An input port is connected with a refrigerant tube on a side of the condenser 22, a first output port is connected with a branching tube configuring the refrigerant branching passage 201 on the refrigerated compartment evaporator 23A, and a second output port is connected with a branching tube configuring the refrigerant branching passage 202 on the freezer compartment evaporator 23B. The refrigerant control valve 31 individually controls an opening degree of the first output port and the second output port using a control signal from the control device 32.

Hereinafter, an embodiment of an operation pattern of the refrigerant control valve 31 by the control device 32 will be described with reference to FIGS. 2 and 3.

The control device 32 individually adjusts the refrigerant flow rate that flows into the refrigerated compartment evaporator 23A and the refrigerant flow rate that flows into the freezer compartment evaporator 23B by controlling an opening and closing time of the refrigerant control valve 31 depending on loads of the refrigerated compartment 11 and the freezer compartment 12 or a change in the loads in a simultaneous cooling operation of simultaneously cooling the refrigerated compartment 11 and the freezer compartment 12, thereby adjusting a division ratio of the refrigerants flowing in the respective evaporators.

Specifically, the control device 32 obtains a detected temperature from a temperature sensor 4A installed inside the refrigerated compartment 11 to detect an internal temperature of the refrigerated compartment 11, a detected temperature of the freezer compartment 12 from a temperature sensor 4B installed inside the freezer compartment 12 to detect an internal temperature of the freezer compartment 12, and a detected temperature from an external air temperature sensor 5 installed outside the cooling device 100 to detect an external air temperature.

Also, the control device 32 calculates a load of the refrigerated compartment 11 or a change in the load from the internal temperature of the refrigerator and the external air temperature and simultaneously calculates a load of the freezer compartment 12 or a change in the load from the internal temperature of the refrigerator and the external air temperature, and calculates a time ratio of a fully opened time of the first output port and the second output port of the refrigerant control valve to a fully closed time thereof from the calculated result. The control device 32 outputs a control signal obtained by the calculation to the refrigerant control valve 31 to control the refrigerant control valve 31.

In this case, a switching cycle of the fully opened time and the fully closed time varies from 3 to 200 seconds, and the time ratio of the fully opened time to the fully closed time varies between corresponding switching cycles.

For example, when the fully opened time is referred to as TON and the fully closed time is referred to as TOFF, the period of TON+TOFF may be from 3 to 200 seconds. Also, the time ratio of the fully opened time to the fully closed time is determined by, for example, being appropriately varied based on detected signals from the temperature sensor 4A in the refrigerated compartment 11 and the temperature sensor 4B in the freezer compartment 12.

Figure 2:
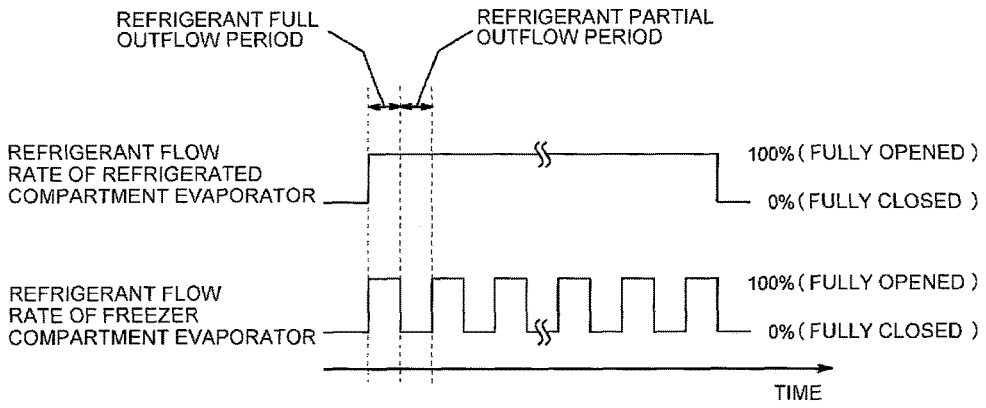
FIG. 2 is a view illustrating a first operation pattern of a refrigerant control valve according to the first embodiment.

The control device 32, as shown in FIG. 2, alternately performs a full refrigerant outflow period in which the refrigerant flows to both of the refrigerated compartment evaporator 23A and the freezer compartment evaporator 23B and a partial refrigerant outflow period in which the refrigerant flows only to the refrigerated compartment evaporator 23A by controlling an opening and closing time of the first port and the second port of the refrigerant control valve 31. In this case, when the first port is fully opened all the time, the refrigerant flows to the refrigerated compartment evaporator 23A, and the time ratio of the fully opened time of the second port to the fully closed time thereof is controlled, thereby enabling the refrigerant to intermittently flow to the freezer compartment evaporator 23B.

Figure 3:
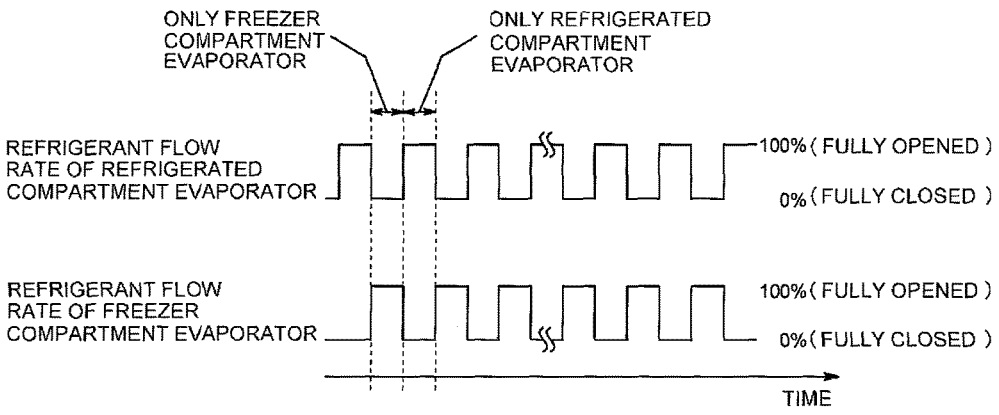
FIG. 3 is a view illustrating a second operation pattern of the refrigerant control valve according to the first embodiment.

Also, the control device 32, as shown in FIG. 3, may allow the refrigerant to sequentially flow to the refrigerated compartment evaporator 23A and the freezer compartment evaporator 23B by controlling the opening and closing time of the first port and the second port of the refrigerant control valve 31. In this case, the control device 32 controls the time ratio of the fully opened time of the first port and the second port to the fully closed time thereof to enable the refrigerant to intermittently flow to the refrigerated compartment evaporator 23A and the freezer compartment evaporator 23B and enable a timing at which the refrigerant flows to the refrigerated compartment evaporator 23A and a timing at which the refrigerant flows to the freezer compartment evaporator 23B to be opposites of each other. Also, the operation pattern may be performed only when a unidirectional flow of the refrigerant is generated by the operation pattern shown in FIG. 2.

Effect of First Embodiment

According to the cooling device 100 configured as above, since the simultaneous cooling operation for simultaneously cooling the refrigerated compartment 11 and the freezer compartment 12 is performed, all evaporators perform the cooling operation, and thus it is difficult for the refrigerant to gather in the corresponding evaporators 23A and 23B. Also, since the opening and closing time of the refrigerant control valve 31 is controlled depending on the loads of the refrigerated compartment 11 and the freezer compartment 12 or a change in the loads when the simultaneous cooling operation is performed, the refrigerant flow rate may be responsively controlled depending on the loads or the change in the loads, and the temperatures of the refrigerated compartment 11 and the freezer compartment 12 may be precisely controlled with an excellent response, thereby impeding the spoiling of foods stored in the refrigerated compartment 11 and the freezer compartment 12 and also reducing power consumption when overheating of the evaporators 23A and 23B is controlled. In addition, when the opening degree of a valve is controlled in the cooling device with a low refrigerant flow rate, it is difficult to control the opening degree of the valve, and thus, in the embedment, the opening and closing time of the refrigerant control valve 31 is controlled to easily and precisely control the refrigerant flow rate.

Modification of the First Embodiment

Figure 4:
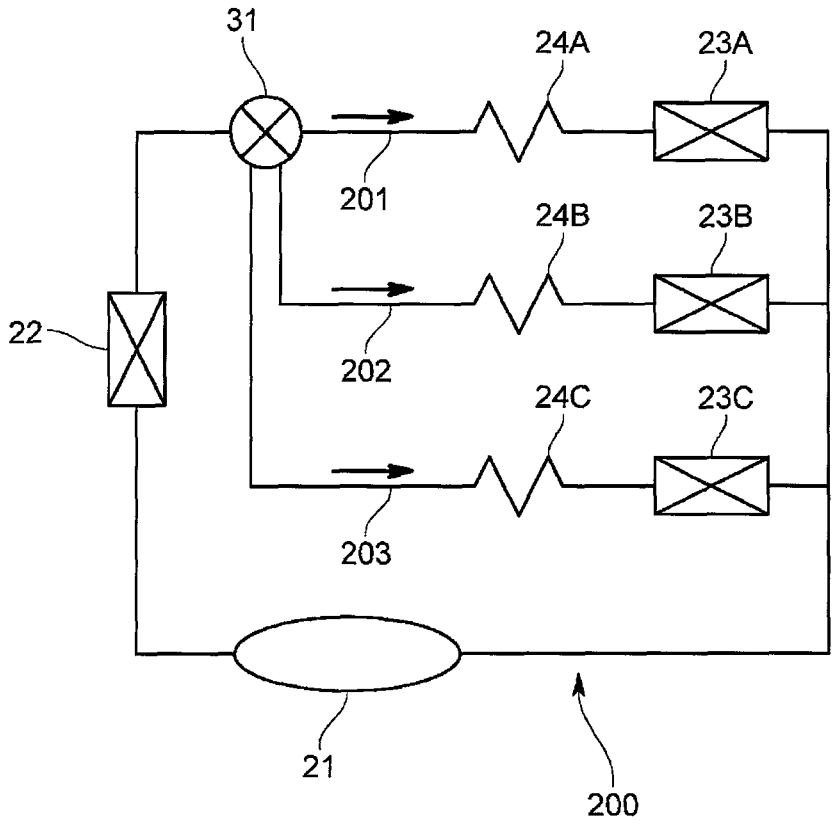
FIG. 4 is a schematic configuration diagram of a cooling device according to a modification of the first embodiment.

Also, the present invention is not limited to the first embodiment. For example, in the first embodiment, the cooling device 100 having the refrigerated compartment 11 and the freezer compartment 12 was described but, as shown in FIG. 4, the cooling device 100 may include three evaporators 23A to 23C installed to correspond to three or more cooling chambers (three cooling chambers in FIG. 4) with different cooling temperatures. In this case, a 4-way valve 31 may be installed as a refrigerant control valve at a branching point of refrigerant branching passages 201 to 203 that are branched into three passages to control a refrigerant flow rate of each of the refrigerant branching passages 201 to 203. Also, 24A to 24C are a decompression means installed upstream of the evaporators.

Figure 5:
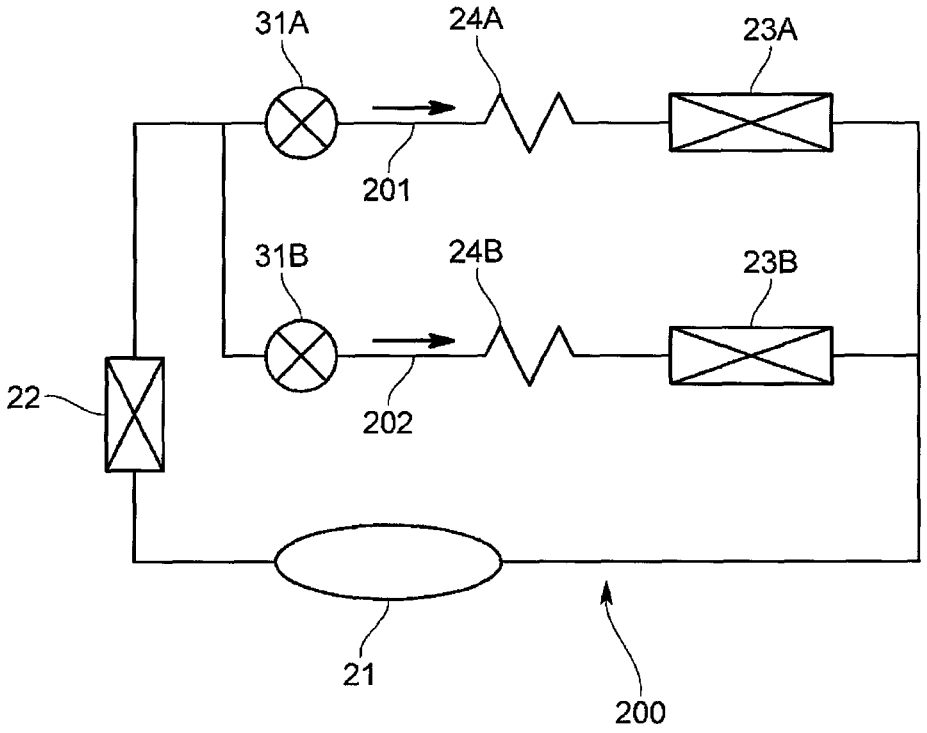
FIG. 5 is a schematic configuration diagram of a cooling device according to a modification of the first embodiment.

Also, in the first embodiment, the 3-way valve 31 may be installed at the branching point of the three refrigerant branching passages 201 and 202 as the refrigerant control valve but, as shown in FIG. 5, two 2-way valves 31A and 31B may be respectively installed upstream of the decompression means 24A and 24B at the refrigerant branching passages 201 and 202. Even in this case, a time ratio of opening and closing times of the two 2-way valves 31 varies from 3 to 200 seconds.

Figure 6:
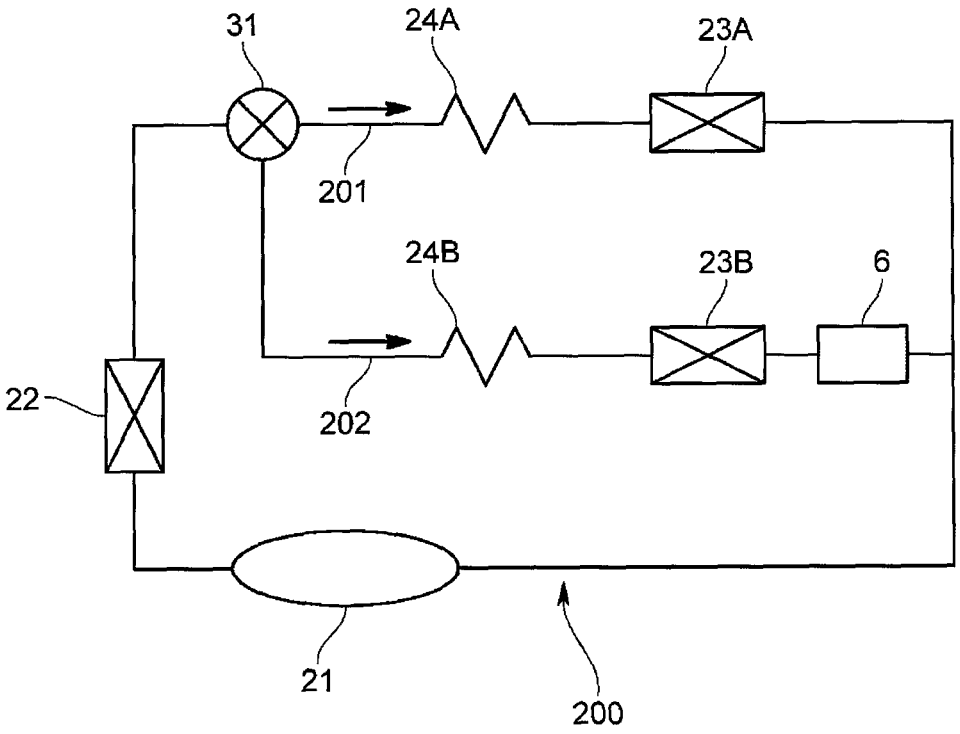
FIG. 6 is a schematic configuration diagram of a cooling device according to a modification of the first embodiment.

As shown in FIG. 6, a check valve 6 that prevents the refrigerant from back-flowing may be installed on an outlet side of the freezer compartment evaporator 23B.

Second Embodiment

Hereinafter, a second embodiment of the present invention will be described with reference to the drawings.

Figure 7:
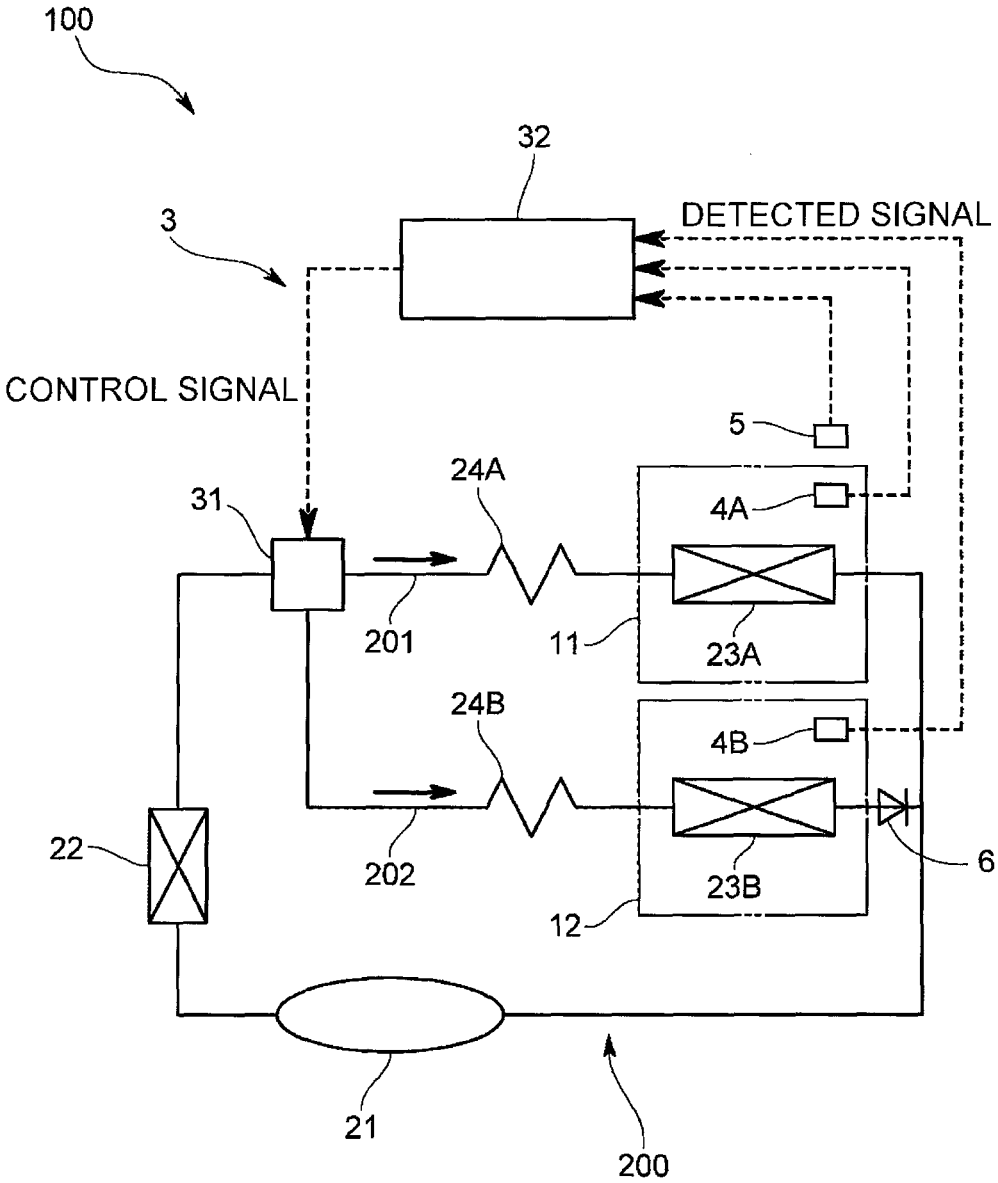
FIG. 7 is a schematic configuration diagram of a cooling device according to a second embodiment.

A cooling device 100 according to the second embodiment, as shown in FIG. 7, includes a refrigerated compartment 11, a freezer compartment 12, and a refrigeration circuit 200 including a compressor 21, a condenser 22 installed at an outlet side of the corresponding compressor 21, a refrigerated compartment evaporator 23A and a freezer compartment evaporator 23B installed between the outlet side of the corresponding condenser 22 and an inlet side of the compressor 21 and connected with each other in parallel, and a refrigerated compartment decompression means 24A, for example a capillary tube, installed in series at an inlet side of the refrigerated compartment evaporator 23A and a freezer compartment decompression means 24B, for example a capillary tube, installed in series at an inlet side of the freezer compartment evaporator 23B.

In this case, the refrigerated compartment evaporator 23A and the freezer compartment evaporator 23B are respectively installed at two refrigerant branching passages 201 and 202 branched from the outlet side of the condenser 22. The refrigerated compartment evaporator 23A is installed to cool the inside of the refrigerated compartment 11, and the freezer compartment evaporator 23B is installed to cool the inside of the freezer compartment 12. Also, a check valve 6 that prevents the refrigerant from back-flowing is installed at an outlet side of the freezer compartment evaporator 23B.

The cooling device 100 of the embodiment, as shown in FIG. 7, includes a refrigerant control unit 3 individually controlling the refrigerant flow rate that flows into the refrigerated compartment evaporator 23A and the freezer compartment evaporator 23B by adjusting the refrigerant flow rate that flows into each of the refrigerant branching passages 201 and 202.

The refrigerant control unit 3 includes a refrigerant control valve 31 that controls the refrigerant flow rate that flows into the refrigerated compartment evaporator 23A and the freezer compartment evaporator 23B and a control device 32 that controls the corresponding refrigerant control valve 31.

Figure 8:
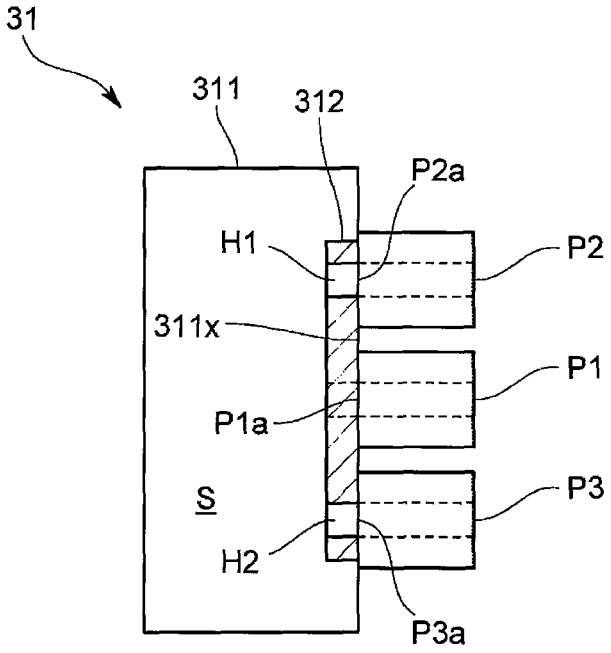
FIG. 8 is a schematic view illustrating a configuration of a refrigerant control valve according to the second embodiment.

The refrigerant control valve 31 of the embodiment, as shown in FIG. 8, is a 3-way valve installed at a branching point of the refrigerant branching passages 201 and 202. An input port P1 is connected with a refrigerant tube on a side of the condenser 22, a first output port P2 is connected with a branching tube configuring the refrigerant branching passage 201 on the refrigerated compartment evaporator 23A, and a second output port P3 is connected with a branching tube configuring the refrigerant branching passage 202 on a side of the freezer compartment evaporator 23B.

Figure 9:
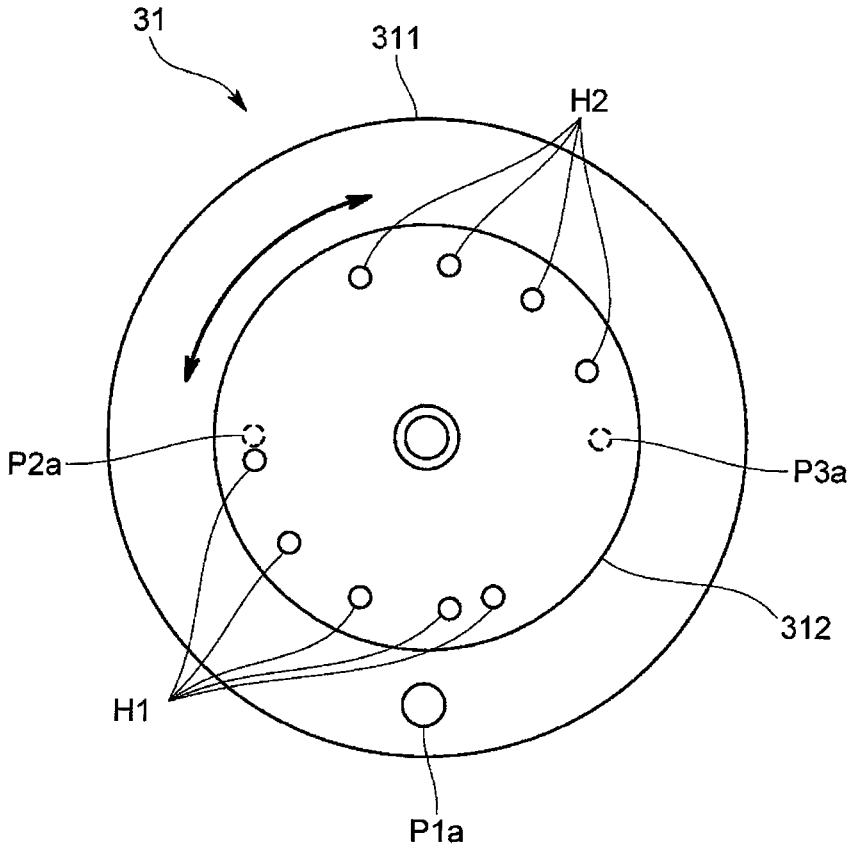
FIG. 9 is a schematic view mainly illustrating a configuration of an outlet and a valve body of the refrigerant control valve according to the second embodiment.

Specifically, the refrigerant control valve 31, as shown in FIGS. 8 and 9, includes a valve main body 311 including the input port P1, the first output port P2, and the second output port P3 and having an inner space S which allows the inlet and output ports to be in communication with each other, and a valve body 312 installed in the inner space S of the valve main body 311 and including a plurality of communication holes H1 and H2 allowing the input port P1 and the two output ports P2 and P3 to be fully or partially in communication with each other. Also, numeral reference P1*a* refers to an inlet connected with the input port P1.

In the refrigerant control valve 31 of the embodiment, an outlet-formed surface (a valve seat, 311*x*) on which outlets P2*a* and P3*a* of the two output ports P2 and P3 are formed is flat. The valve body 312 slidably rotates around a predetermined rotating shaft on an outlet-formed surface 311*x* to open and close each of the outlets P2*a* and P3*a*. The rotating shaft of the valve body 312 is a shaft installed to be equidistant from the two outlets P2*a* and P3*a*, and more specifically, is a center point of the two outlets P2*a* and P3*a*.

The valve body 312 has a disk shape and has the plurality of communication holes H1 and H2 formed in a circumferential direction with respect to the rotating shaft. In the embodiment, a plurality of first communication holes H1 (5 holes in FIG. 9) corresponding to the outlet P2*a* of the first output port P2 and a plurality of second communication holes H2 (4 holes in FIG. 9) corresponding to the outlet P3*a* of the second output port P3 are formed. The valve body 312 rotates about the rotating shaft so that the first communication hole H1 corresponding to the outlets P2*a* and the corresponding outlet P2*a* overlap with each other or the second communication hole H2 corresponding to the outlet P3*a* and the corresponding outlet P3*a* overlap with each other, and thus the input port P1 is in communication with the first output port P2 and/or the second output port P3.

Therefore, a combination of a valve opening state in which the refrigerant flows to each of the refrigerated compartment evaporator 23A and the freezer compartment evaporator 23B and a valve closing state in which the refrigerant does not flow is determined, and a plurality of opening and closing states different from each other (opening and closing selection modes) are determined. That is, in the embodiment, (1) a fully closed mode ("closed-closed" mode) in which the refrigerant does not flow to the refrigerated compartment evaporator 23A and the freezer compartment evaporator 23B, (2) a refrigerated compartment-selecting mode ("opened-closed" mode) in which the refrigerant flows to the refrigerated compartment evaporator 23A but does not flow to the freezer compartment evaporator 23B, (3) a freezer compartment-selecting mode ("closed-opened" mode) in which the refrigerant does not flow to the refrigerated compartment evaporator 23A but flows to the freezer compartment evaporator 23B, and (4) a fully opened mode ("opened-opened" mode) in which the refrigerant flows to the refrigerated compartment evaporator 23A and the freezer compartment evaporator 23B.

Further, in the embodiment, the plurality of communication holes H1 corresponding to the outlet P2*a* of the first output port P2 and the plurality of communication holes H2 corresponding to the outlet P3*a* of the second output port P3 are formed at the valve body 312 so that the refrigerated compartment-selecting mode ("opened-closed" mode) and the freezer compartment-selecting mode ("closed-opened" mode) are alternately switched many times as the valve body 312 rotates during one stroke. That is, the plurality of communication holes H1 and the plurality of communication holes H2 are formed at the valve body 312 as if an opening and closing routine of sequentially switching between the refrigerated compartment-selecting mode ("opened-closed" mode) to the freezer compartment-selecting mode ("closed-opened" mode) is repeated as the valve body 312 rotates during one stroke.

Also, the refrigerant control valve 31 includes a gear engaged with a gear part (not shown) formed on the valve body 312 and an actuator, such as a step motor and the like, rotating the corresponding gear 313, and the valve body 312 is rotated by the corresponding actuator through the gear. Also, the actuator is able to rotate the valve body 312 forward or backward. That is, each valve body 312 is reciprocated in a predetermined rotation range by the gear.

Further, as the actuator is controlled by the control signal from the control device 32, the valve body 312 rotates, and the refrigerant control valve 31 switches the opening and closing modes of the outlets P2*a* and P3*a* of the two output ports P2 and P3.

The control device 32 is a general or exclusive computer including a CPU, a memory, an input output interface, an AD converter and the like, and controls the refrigerant control valve 31 by enabling the CPU, peripheral devices and the like to cooperate with each other according to a control program stored in a predetermined area of the memory.

Specifically, the control device 32 obtains a detected temperature from a temperature sensor 4A installed in the refrigerated compartment 11 to detect an internal temperature of the corresponding refrigerated compartment 11, a detected temperature from a temperature sensor 4B installed in the freezer compartment 12 to detect an internal temperature of the corresponding freezer compartment 12, and a detected temperature form an external air temperature sensor 5 installed outside the cooling device 100 to detect an external air temperature.

Also, the control device 32 calculates a load of the refrigerated compartment 11 or a change in the load from the internal temperature of the refrigerator and the external air temperature and simultaneously calculates a load of the freezer compartment 12 or a change in the load from the internal temperature of the refrigerator and the external air temperature, and determines the opening and closing modes of the outlet P2*a* of the first output port P2 and the outlet P3*a* of the second output port P3 of the refrigerant control valve 31 based on the calculation result. The control device 32 controls the refrigerant control valve 31 by outputting a control signal obtained through the above mentioned calculation to the refrigerant control valve 31.

A control state of a refrigerant flow rate in the refrigerant control unit 3 of the embodiment will be described with reference to FIGS. 10 and 11.

Figure 10:
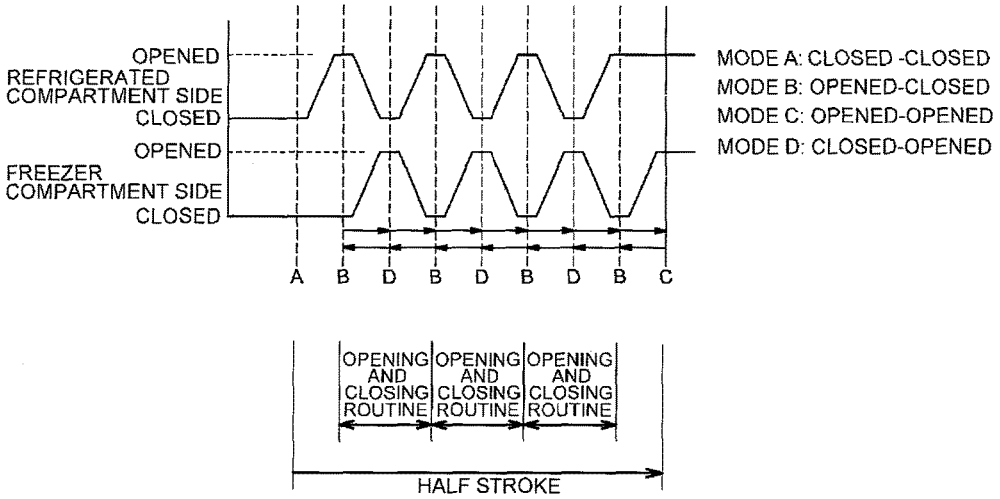
FIG. 10 is a view illustrating an operation pattern of the refrigerant control valve according to the second embodiment.

The refrigerant control valve 31 of the embodiment, as shown in FIGS. 10 and 11, switches from the fully closed mode ("closed-closed" mode: mode A) in which the refrigerant does not flow to both the refrigerated compartment evaporator 23A and the freezer compartment evaporator 23B to the refrigerated compartment selecting mode ("opened-closed" mode: mode B) when the valve body 312 rotates. Then, when the valve body 312 rotates further, the refrigerated compartment selecting mode is switched into the freezer compartment selecting mode ("closed-opened" mode: mode D). As the valve body 312 rotates during one stroke, the mode B and the mode D are alternately switched between each other, and an opening and closing routine is repeated many times (see FIG. 10). That is, as the valve body 312 rotates, communication between the first communication hole H1 and the outlet P2*a* and communication between the second communication hole H2 and the outlet P3*a* are alternately switched between each other (see FIG. 11). Then, when the valve body 312 rotates further, the mode is switched to the fully opened mode ("opened-opened" mode: mode C) in which the refrigerant flows to the refrigerated compartment evaporator 23A and the freezer compartment evaporator 23B. The state from the mode A to the mode C is a portion of a half of the stroke. The valve body 312, as mentioned above, rotates backward for the portion of the rest of the stroke while the mode B and the mode C are alternately switched between each other, that is, the opening and closing routine is repeated several times. Like this, one stroke of the valve body 312 of the embodiment refers to one operation in which the valve body 312 rotates forward from an initial position in a predetermined angle range, for example, an angle of 180 degrees or less but approximately an angle of 100 degrees in the embodiment, and then rotates backward to the initial position. Also, the valve body 312 rotates forward or backward without passing through the mode A and mode C to extend the number (the number of opening and closing routines) of switching from the mode B to the mode D.

Effect of Second Embodiment

According to the cooling device 100 configured as above, since the refrigerant control valve 31 has the same several opening and closing routines from the refrigerated compartment selecting mode and the freezer compartment selecting mode during an one stroke operation of the valve body 312 and switches between the refrigerated compartment selecting mode and the freezer compartment selecting mode several times during one stroke to reciprocate in the same place, the number of repeated operations is reduced, thereby increasing the durability of the refrigerant control valve 31. Also, the same several opening and closing routines are provided during an one stroke operation of the valve body 312 so that each movement distance between the opening and closing selecting modes may be reduced and the movement time may be reduced, and thus the temperatures of the refrigerated compartment 11 and the freezer compartment 12 are precisely controlled. Particularly, in the embodiment, since the opening and closing routine is repeated several times from the refrigerated compartment selecting mode and the freezer compartment selecting mode as the valve body 312 rotates during one stroke, the switching between the refrigerated compartment selecting mode and the freezer compartment selecting mode of the valve body 312 can be performed with small movement, and the movement time of the valve body 312 may be further reduced, and thus the temperatures of the refrigerated compartment 11 and the freezer compartment 12 can be precisely controlled.

Modification of Second Embodiment

The present invention is not limited to the second embodiment.

Figure 12:
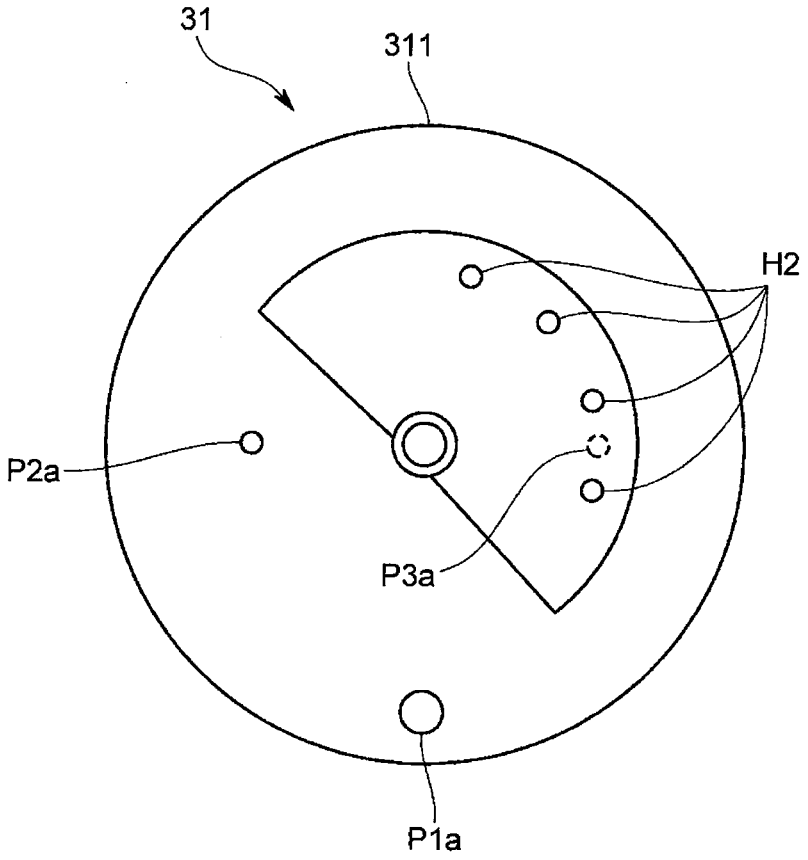
FIG. 12 is a schematic view mainly illustrating a configuration of an outlet and a valve body of a refrigerant control valve according to a modification of the second embodiment.

For example, in the second embodiment, the refrigerant control valve 31 switches a mode between the refrigerated compartment selecting mode and the freezer compartment selecting mode, but the refrigerant control valve 31 may have a one-side selecting mode in which the refrigerant flows to one of the refrigerated compartment evaporator 23A and the freezer compartment evaporator 23B and a both-side selecting mode in which the refrigerant flows to both of the refrigerated compartment evaporator 23A and the freezer compartment evaporator 23B and may have several opening and closing routines from the one-side selecting mode and the both-side selecting mode during an one stroke operation of the valve body 312. Specifically, as shown in FIG. 12, the valve body 312 has a half disk shape and has a plurality of communication holes H2 in a circumferential direction around a rotating shaft. In detail, the valve body 312 has a plurality of second communication holes H2 (four holes in FIG. 12) corresponding to the outlet P3*a* of the second output port P3. As the valve body 312 rotates around the rotating shaft, the second communication holes H2 corresponding to the outlet P3*a* overlap with the corresponding outlet P3*a*, and the input port P1 and the second output port P3 come into communication with each other. Also, the outlet P2*a* is opened all the time except for in the mode A of FIG. 13 and is in communication with the input port P1 and the first output port P2 all the time.

Therefore, the combination of an opened valve state in which the refrigerant flows to each of the refrigerated compartment evaporator 23A and the freezer compartment evaporator 23B and a closed valve state in which the refrigerant does not flow is determined, and a plurality of opening and closing states different from each other (opening and closing selection modes) are determined. That is, in the embodiment, (1) a fully closed mode ("closed-closed" mode) in which the refrigerant does not flow to the refrigerated compartment evaporator 23A and the freezer compartment evaporator 23B, (2) a refrigerated compartment selecting mode ("opened-closed" mode) that is the one-side selecting mode in which the refrigerant flows to the refrigerated compartment evaporator 23A but does not flow to the freezer compartment evaporator 23B, and (3) a fully opened mode ("opened-opened" mode) that is the both-side selecting mode in which the refrigerant flows to the refrigerated compartment evaporator 23A and the freezer compartment evaporator 23B is determined.

Figure 13:
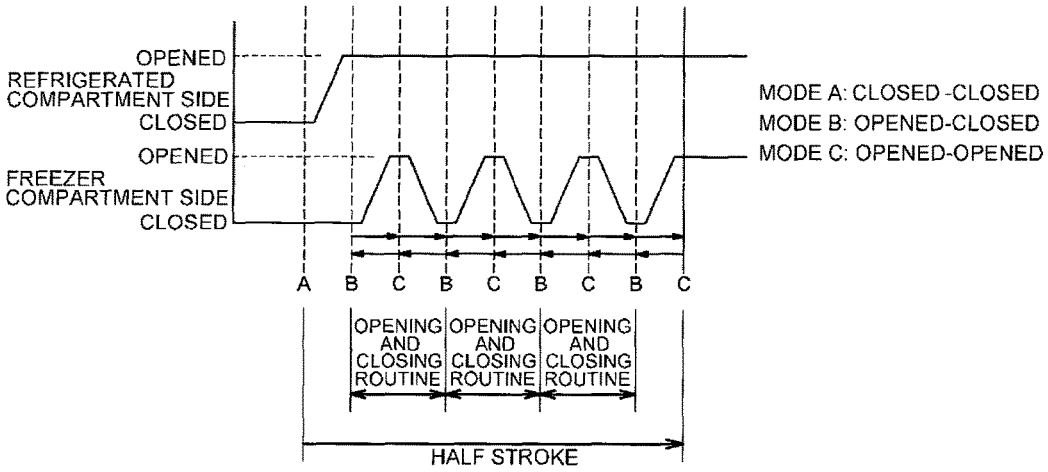
FIG. 13 is a view illustrating an operation pattern of the refrigerant control valve in the modification of the second embodiment.

Next, in the refrigerant control valve 31, as shown in FIGS. 13 and 14, when the valve body 312 rotates in the fully closed mode ("closed-closed" mode: mode A) in which the refrigerant does not flow to both of the refrigerated compartment evaporator 23A and the freezer compartment evaporator 23B, the mode A is switched into the refrigerated compartment selecting mode ("opened-closed" mode: mode B). Then, when the valve body 312 rotates further in the refrigerated compartment selecting mode, the mode B is switched into the fully opened mode ("opened-opened" mode: mode C). As the valve body 312 rotates during one stroke, the mode B and the mode C are alternatively switched, and the opening and closing routine is repeated several times (see FIG. 13). That is, as the valve body 312 rotates, communication and blocking between the second communication hole H2 and the outlet P3*a* are alternately switched while the first communication hole H1 and the outlet P2*a* are in communication with each other all the time (see FIG. 14). Next, the valve body 312 rotates backward to alternately switch between the mode B and the mode C, and the opening and closing routine is repeated several times. In this case, the time ratio of the refrigerated compartment selecting mode (mode B) to the fully opened mode (mode C) in the refrigerant control valve 31 is controlled, and thus the ratio of the refrigerant flow rate of the refrigerated compartment evaporator 23A to the refrigerant flow rate of the freezer compartment evaporator 23B may be adjusted.

Also, the refrigerant control valve 31 has been a pad type slide valve having the valve body 312 with a disk shape, a half-disk shape or the like, but may be a slide valve having a valve body having other shapes or may be, for example, a spool valve having a plurality of inner passages in which the inlet P1*a* of the input port P1 and the outlets P2*a* and P3*a* of the output port P2 and P3 may individually come into communication.

Third Embodiment

Hereinafter, a third embodiment of the present invention will be described with reference to the drawings.

Figure 15:
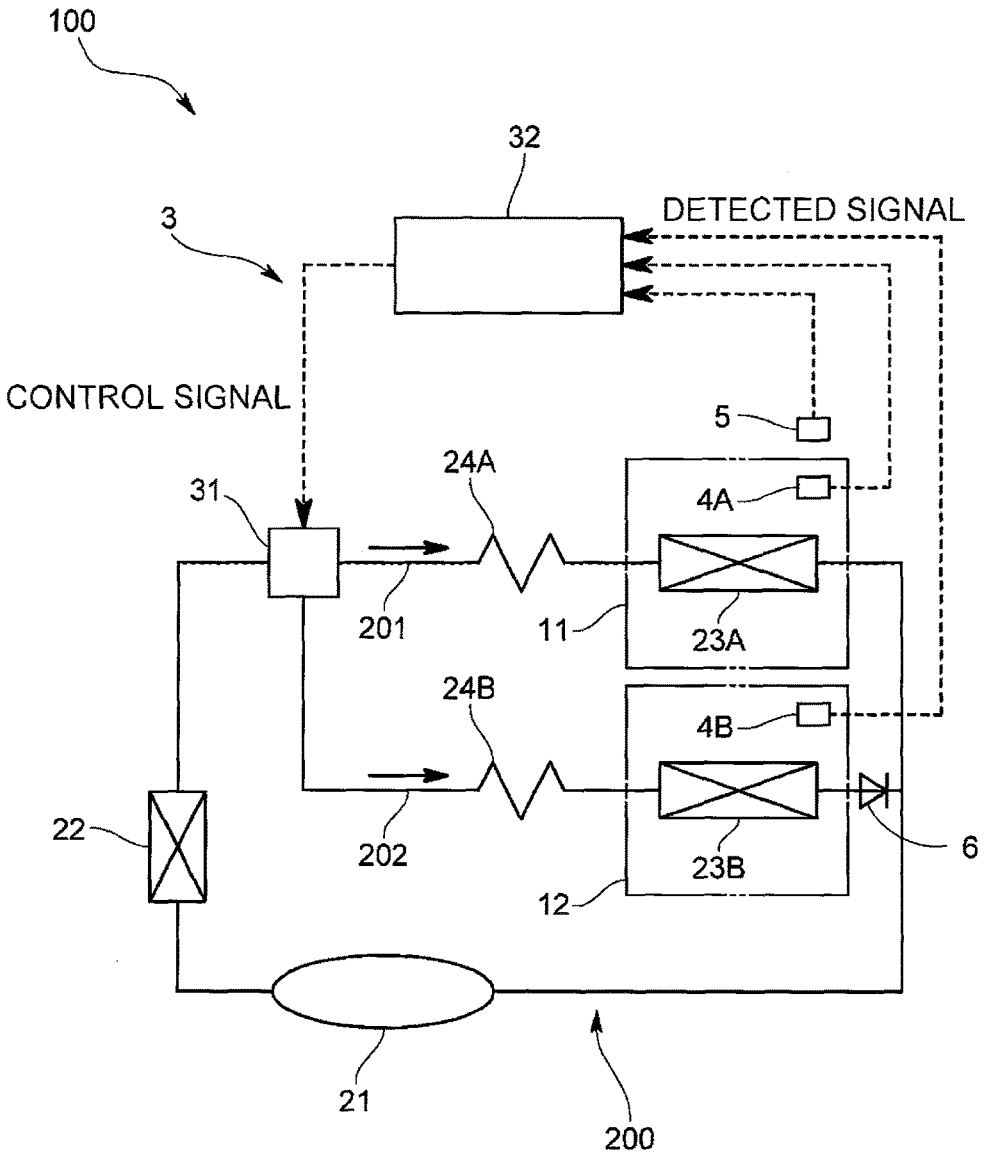
FIG. 15 is a schematic configuration diagram of a cooling device according to a third embodiment.

A cooling device 100 according to the third embodiment, as shown in FIG. 15, includes a refrigerated compartment 11, a freezer compartment 12, and a refrigeration circuit 200 including a compressor 21, a condenser 22 installed at an outlet side of the corresponding compressor 21, a refrigerated compartment evaporator 23A and a freezer compartment evaporator 23B installed between the outlet side of the corresponding condenser 22 and an inlet side of the compressor 21 and connected with each other in parallel, and a refrigerated compartment decompression means 24A, for example a capillary tube, installed in series at an inlet side of the refrigerated compartment evaporator 23A and a refrigerated compartment decompression means 24B, for example a capillary tube, installed in series at an inlet side of the freezer compartment evaporator 23B.

In this case, the refrigerated compartment evaporator 23A and the freezer compartment evaporator 23B are installed in two refrigerant branching passages 201 and 202 branched from the outlet side of the condenser 22, respectively. The refrigerated compartment evaporator 23A is installed to cool the inside of the refrigerated compartment 11, and the freezer compartment evaporator 23B is installed to cool the inside of the freezer compartment 12. Also, a check valve 6 that prevents a refrigerant from back-flowing is installed on the outlet side of the freezer compartment evaporator 23B.

The cooling device 100 of the embodiment, as shown in FIG. 15, includes a refrigerant control unit 3 that controls a refrigerant flow rate that flows to the refrigerated compartment evaporator 23A and the freezer compartment evaporator 23B by continuously and simultaneously changing a refrigerant flow rate by adjusting a refrigerant flow rate that flows into each of the refrigerant branching passages 201 and 202.

The refrigerant control unit 3 includes a refrigerant control valve 31 that controls the refrigerant flow rate that flows into the refrigerated compartment evaporator 23A and the freezer compartment evaporator 23B and a control device 32 that controls the corresponding refrigerant control valve 31.

Figure 16:
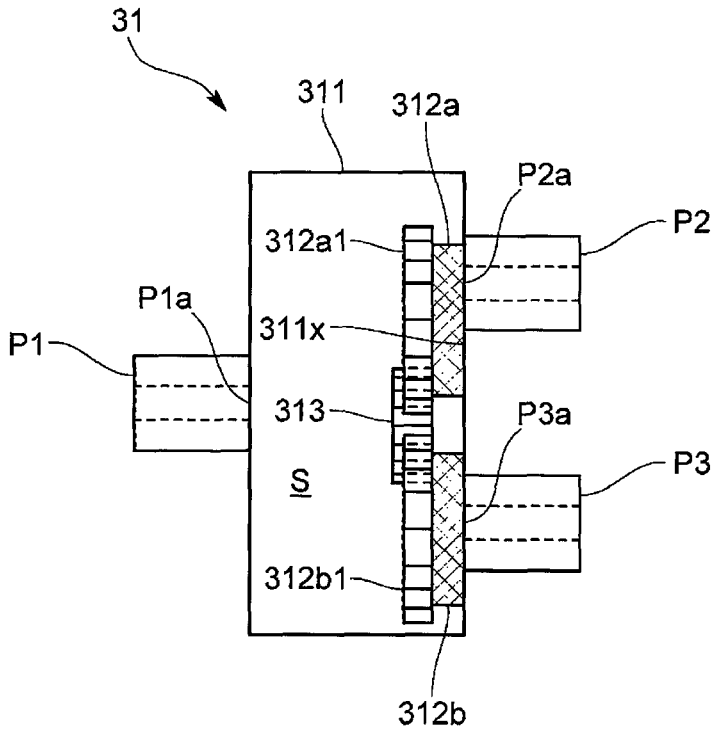
FIG. 16 is a schematic view illustrating a configuration of a refrigerant control valve of the third embodiment.

The refrigerant control valve 31 of the embodiment, as shown in FIG. 16, is a 3-way valve installed at a branching point of the refrigerant branching passages 201 and 202. An input port P1 is connected with a refrigerant tube on the condenser 22, a first output port P2 is connected with a branching tube configuring the refrigerant branching passage 201 on the refrigerated compartment evaporator 23A, and a second output port P3 is connected with a branching tube configuring the refrigerant branching passage 202 on the freezer compartment evaporator 23B.

Figure 17:
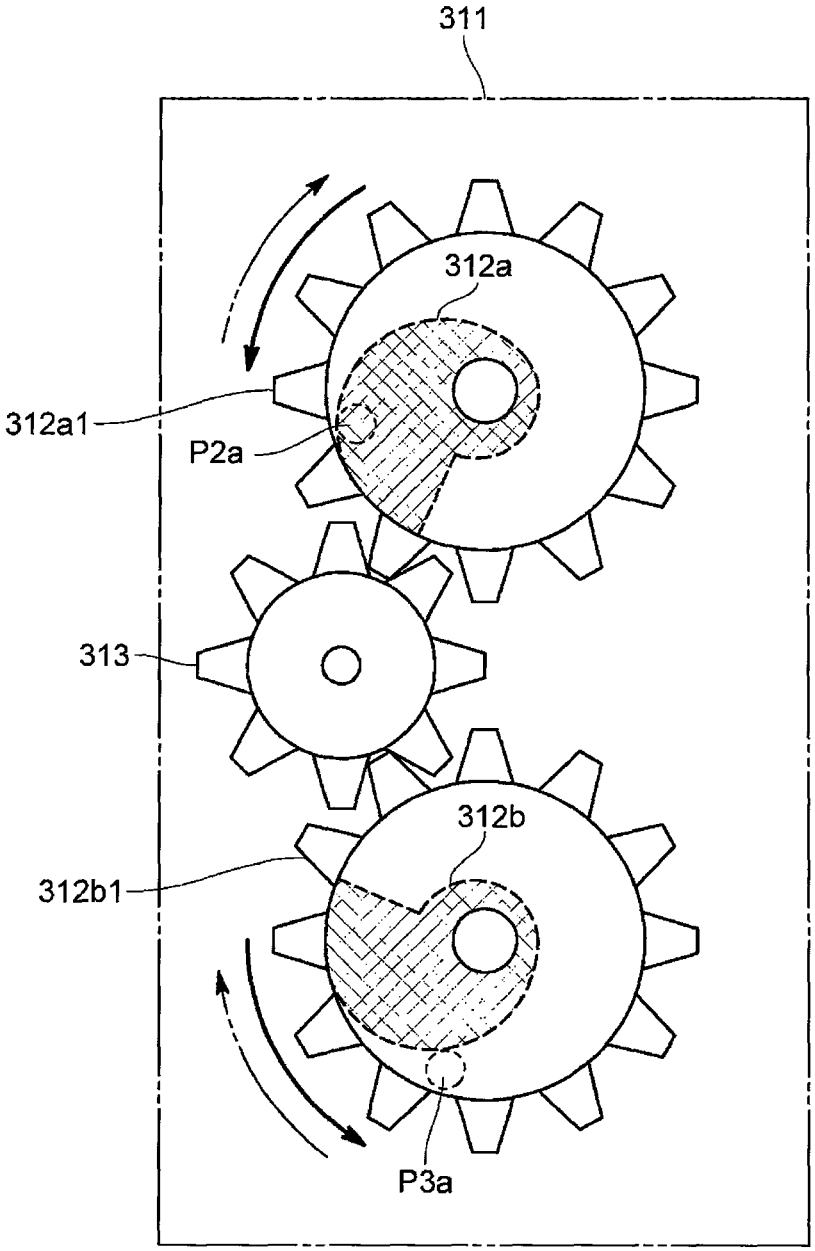
FIG. 17 is a schematic view illustrating an inner configuration of the refrigerant control valve of the third embodiment.

Specifically, the refrigerant control valve 31, as shown in FIGS. 16 and 17, includes a valve main body 311 including the input port P1, the first output port P2, and the second output port P3 and having an inner space S allowing the inlet and output ports to be in communication with each other, and two valve bodies 312*a* and 312*b* installed in the inner space S of the valve main body 311 to respectively correspond to the two output ports P2 and P3, and opening and closing the outlets P2*a* and P3*a* connected with the outlets P2 and P3. Also, the numeral reference P1*a* refers to an inlet connected with the input port P1.

In the refrigerant control valve 31 of the embodiment, an outlet-formed surface 311*x* on which the outlets P2*a* and P3*a* of the two output ports P2 and P3 are formed is flat. Each of the two valve bodies 312*a* and 312*b* slidably rotates about each predetermined rotating shaft on the outlet-formed surface 311*x* to open and close each of the outlets P2*a* and P3*a*.

In each of the valve bodies 312*a* and 312*b*, the shape of an outline of a part through which the outlets P2*a* and P3*a* pass has a curved shape convex toward a rotation direction. Also, the shape of the outline is the shape of a slide surface sliding on the outlet-formed surface 311*x* when viewed from the rotation direction of the valve bodies 312*a* and 312*b*.

In the embodiment, a shape of an outline in the valve body 312*a* has a curved shape convex toward the rotation direction when the corresponding valve body 312*a* rotates toward a direction of blocking the outlet P2*a*. A shape of an outline in the valve body 312*b* has a curved shape convex toward the rotation direction when the corresponding valve body 312*b* rotates toward a direction of blocking the outlet P3*a*. Also, the shapes of the outlines in the valve bodies 312*a* and 312*b* are an involute curve and have the same shape.

Also, the refrigerant control valve 31 includes a gear 313 engaged with gear parts 312*a*1 and 312*b*1 each formed on the valve bodies 312*a* and 312*b* and an actuator (not shown), such as a step motor and the like, rotating the corresponding gear 313, and the two valve bodies 312*a* and 312*b* are rotated together by the corresponding actuator through the gear 313. Also, the actuator is able to rotate the valve bodies 312*a* and 312*b* forward or backward. That is, each of the valve bodies 312*a* and 312*b* is reciprocated in a predetermined rotation range by the gear 313.

As the actuator is controlled by a control signal from the control device 32, the valve bodies 312*a* and 312*b* rotate, and thus the control valve 31 controls an opening degree of the outlets P2*a* and P3*a* of the two output ports P2 and P3.

The control device 32 is a general or exclusive computer including a CPU, a memory, an input output interface, an AD converter and the like, and controls the refrigerant control valve 31 by enabling the CPU, peripheral devices and the like to cooperate with each other according to a control program stored in a predetermined area of the memory.

Specifically, the control device 32 obtains a detected temperature from a temperature sensor 4A installed in the refrigerated compartment 11 to detect an internal temperature of the corresponding refrigerated compartment 11, a detected temperature from a temperature sensor 4B installed in the freezer compartment 12 to detect an internal temperature of the corresponding freezer compartment 12, and a detected temperature from an external air temperature sensor 5 installed outside the cooling device 100 to detect an external air temperature.

Also, the control device 32 calculates a load of the refrigerated compartment 11 or a change in the load from the internal temperature of refrigerator and the external air temperature and simultaneously calculates a load of the freezer compartment 12 or a change in the load from the internal temperature of refrigerator and the external air temperature, and calculates a ratio of an opening degree of the outlet P2*a* of the second output port P2 of the control valve 31 to an opening degree of the outlet P3*a* of the second output port P3 of the control valve 31 based on the calculation result. The control device 32 controls the refrigerant control valve 31 by outputting a control signal obtained through the above mentioned calculation to the refrigerant control valve 31.

Figure 19:
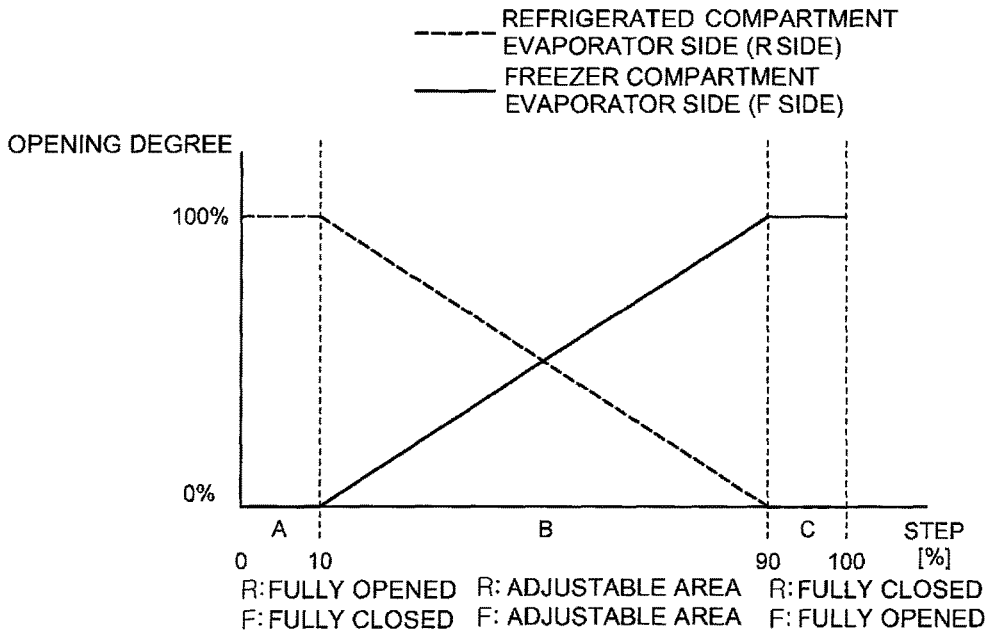
FIG. 19 is a view illustrating a change in an opening degree by the refrigerant control valve of the third embodiment.

A control state of a refrigerant flow rate in the refrigerant control unit 3 of the embodiment will be described with reference to FIGS. 18 and 19.

When each of the valve bodies 312*a* and 312*b* is within a range from an initial position to a position of a rotation range of 10% (an area A), the outlet P2*a* of the first output port P2 is fully opened (an opening degree is 100%) and the outlet P3*a* of the second output port P3 is fully closed (an opening degree is 0%), and thus a refrigerant flow rate ratio for the refrigerated compartment evaporator becomes 100%, and a refrigerant flow rate ratio for the freezer compartment evaporator becomes 0%. Also, the initial position in the embodiment refers to a predetermined position at which the outlet P2*a* of the first output port P2 is fully opened and the outlet P3*a* of the second output port P3 is fully closed.

Also, within a rotation range from 90% to 100% (an area C), the outlet P2*a* of the first output port P2 is fully closed (the opening degree is 0%), and the outlet P3*a* of the second output port P3 is fully opened (the opening degree is 100%), and thus the refrigerant flow rate ratio for the refrigerated compartment evaporator becomes 0%, and the refrigerant flow rate ratio for the freezer compartment evaporator becomes 100%. Also, the rotation range of 100% in the embodiment refers to a predetermined position at which the outlet P2*a* of the first output port P2 is fully closed and the outlet P3*a* of the second output port P3 is fully opened when the valve bodies rotate from the initial position.

Also, a rotation range from 10% to 90% (an area B) is a range in which both opening degrees of the outlet P2*a* of the first output port P2 and the outlet P3*a* of the second output port P3 are adjustable (an adjustable area). In the adjustable area, the opening degree of the outlet P2*a* of the first output port P2 decreases linearly from 100% to 0%, and the opening degree of the outlet P3*a* of the second output port P3 increases linearly from 0% to 100%. That is, an opening degree change rate of the outlet P2*a* of the first output port P2 is regular, and an opening degree change rate of the outlet P3*a* of the second output port P3 is also regular. Also, the opening degree change rate of the outlet P2*a* and the opening degree change rate of the outlet P3*a* are opposite each other.

When the control is performed, a change in the internal temperature of the refrigerated compartment 11 and an inlet temperature and an outlet temperature of the refrigerated compartment evaporator 23A and a change in the internal temperature of the freezer compartment 12 and an inlet temperature and an outlet temperature of the freezer compartment evaporator 23B are shown in FIG. 20. As shown in FIG. 20, it is confirmed that when evaporation temperatures in the refrigerated compartment evaporator 23A and the freezer compartment evaporator 23B are continuously changed in the adjustable area, the internal temperatures of the refrigerated compartment 11 and the freezer compartment 12 are continuously adjusted.

Effect of Third Embodiment

According to the cooling device configured as above, since the refrigerant control unit 3 continuously changes the refrigerant flow rate that flows to the refrigerated compartment evaporator 23A and the freezer compartment evaporator 23B at the same time, a combination pattern of the flow rate ratios may be increased. Therefore, since the evaporation temperature in the refrigerated compartment evaporator 23A and the freezer compartment evaporator 23B may each be arbitrarily adjusted, the flow rate may be precisely controlled depending on the loads of the refrigerated compartment 11 and the freezer compartment 12, thereby increasing the cooling efficiency of the compressor 21 and reducing power consumption.

Modification of Third Embodiment

The present invention is not limited to the third embodiment.

For example, in the third embedment, the rotation range from 0% to 10% refers to the fully opened area (or the fully closed area), the rotation range from 10% to 90% refers to the adjustable area, and the rotation range from 90% to 100% refers to the fully closed area (or the fully opened area), but the rotation range is not limited thereto. The rotation range that refers to the adjustable area is not limited to the above range and may be arbitrarily set to, for example, the range from 20% to 80%. Also, besides the fully opened area, the adjustable area, and the fully closed area, a predetermined opening degree area may be included. Also, like this, the shape of the outline of a portion passing through the outlets P2*a* and P3*a* in the valve bodies 312*a* and 312*b* is set to a specific shape to be divided into each of the areas according to the rotation range.

Figure 21:
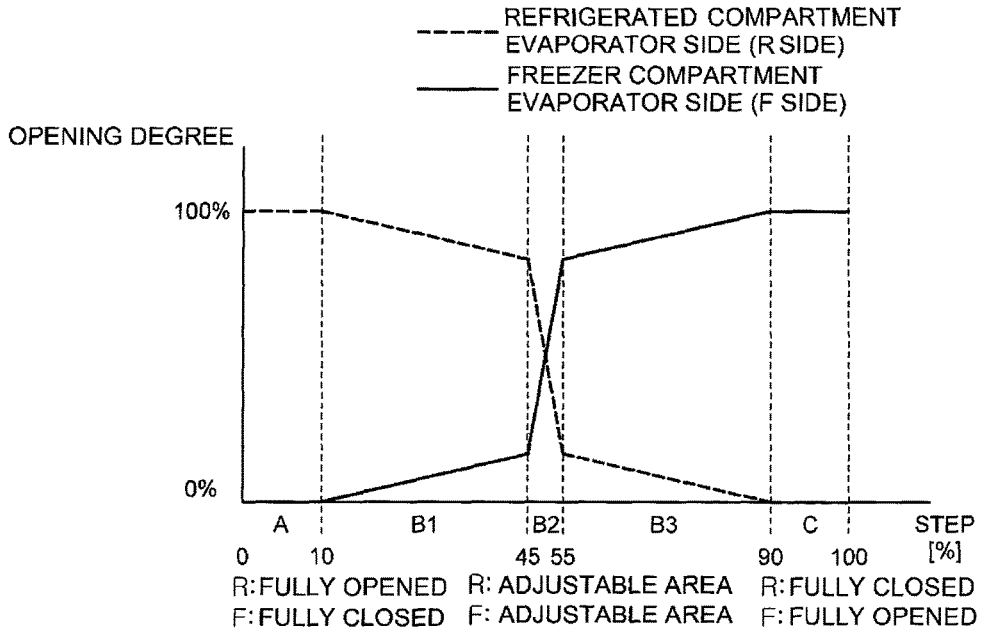
FIG. 21 is a view illustrating a change in an opening degree by a refrigerant control valve in a modification of the third embodiment.

Also, the opening degree change rates of the outlets P2*a* and P3*a* of the output ports P2 and P3 in the adjustable area include a plurality of change rates. For example, as shown in FIG. 21, the adjustable area B may be divided into an area B1 with a low change rate, an area B2 with a high change rate, and an area B3 with a low change rate. In the FIG. 21, the change rates of the area B1 and the area B3 are the same. The opening degree change rate of the outlet P2*a* of the output port P2 and the opening degree change rate of the outlet P3*a* of the output port P3 are opposite each other. The change rates of the area B1 and the area B3 may be different from each other. At this time, in the valve bodies 312*a* and 312B, the shapes of the outlines of the portions passing through the outlets P2*a* and P3*a* have specific shapes, and thus the adjustable area may have a plurality of areas with different change rates.

A change in the internal temperature of the refrigerated compartment 11 and the inlet temperature and the outlet temperature of the refrigerated compartment evaporator, and a change in the internal temperature of the freezer compartment 12 and the inlet temperature and the outlet temperature of the freezer compartment evaporator according to the refrigerant control unit 3 configured as above are shown in FIG. 22. As shown in FIG. 22, the evaporation temperatures in the refrigerated compartment evaporator and the freezer compartment evaporator in the adjustable area are continuously changed, and the internal temperatures of the refrigerated compartment 11 and the freezer compartment 12 may be continuously adjusted. Like this, the opening degree change rate of the outlets P2*a* and P3*a* are arbitrarily set, and the temperature may be more precisely controlled by the sequential change.

Figure 23:
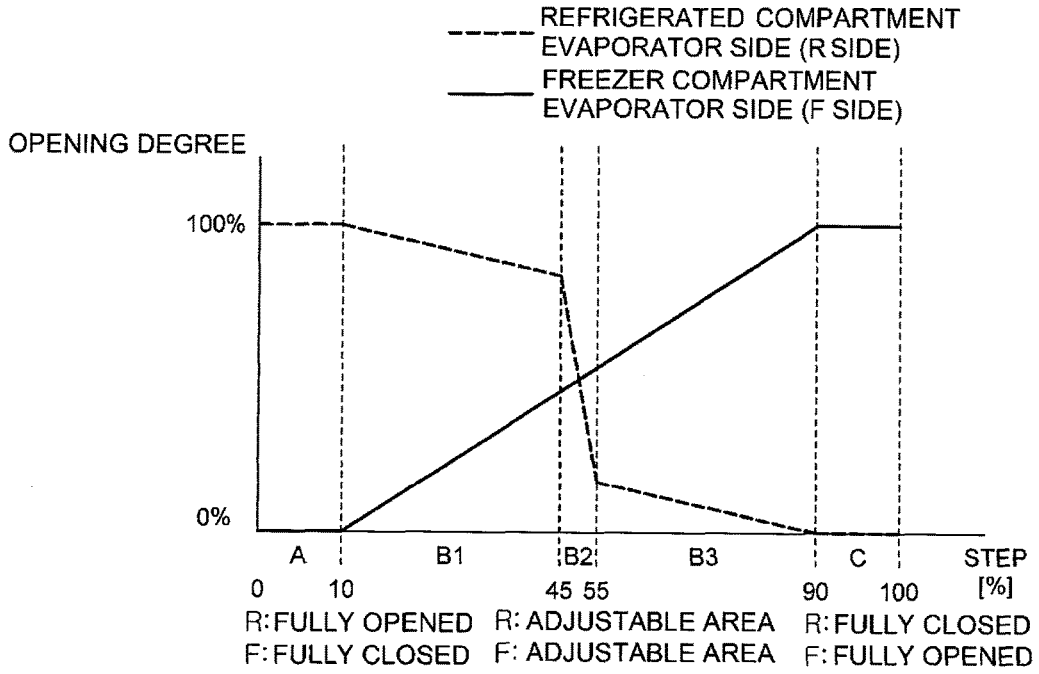
FIG. 23 is a view illustrating a change in the opening degree according to the refrigerator control valve in the modification of the third embodiment.

Also, as shown in FIG. 23, the opening degree change rate of the outlet P2*a* of the first output port P2 and the opening degree change rate of the outlet P3*a* of the second output port P3 in the adjustable area are independently set. That is, the opening degree change rates may be set so that the sum of the opening degree of the outlet P2*a* and the opening degree of the outlet P3*a* does not become 100%. In this case, the shape of the outline of the portion that passes through each of the outlets P2*a* and P3*a* in the valve bodies have different shapes. In FIG. 23, the change rate of the outlet P3*a* of the second output port P3 is uniform, and the change rate of the outlet P2*a* of the first output port P2 has a plurality of change rates. Therefore, even when the refrigerant flow rate of each of the evaporators 23A and 23B is not equal to the opening rates of the outlets of the plurality of output ports by a temperature (a pressure) difference between the corresponding evaporators 23A and 23B, the refrigerant flow rate that flows to each of the evaporator 23A and 23B may be precisely controlled.

Figure 24:
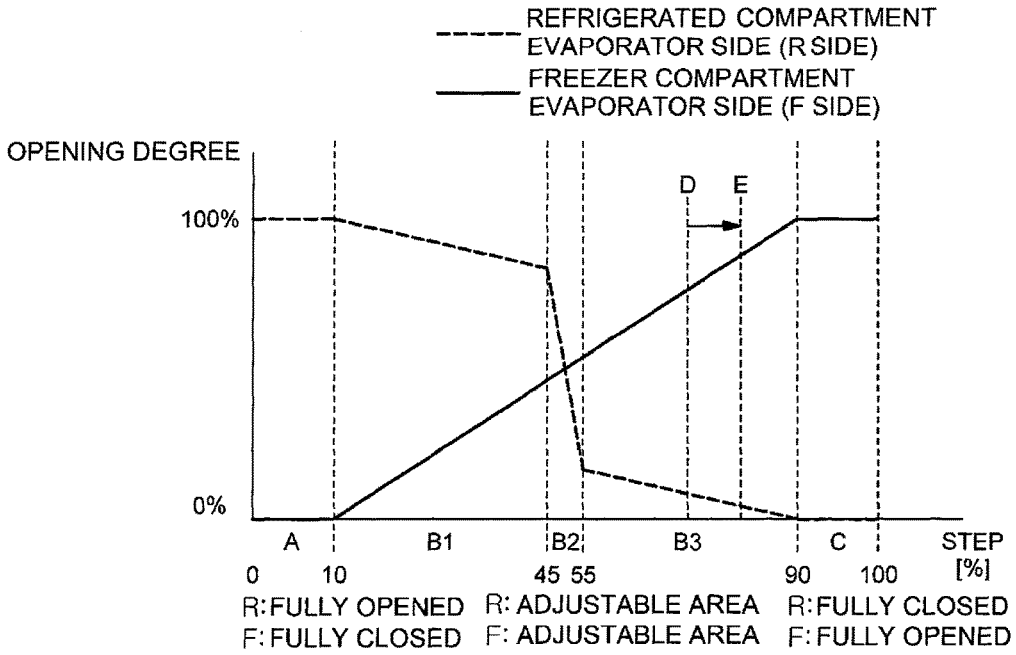
FIG. 24 is a view illustrating a method of minutely adjusting a refrigerant flow rate according to the modification of the third embodiment.

Here, since the temperature (the pressure) of the evaporator is changed when the refrigerated compartment load is changed, the refrigerant flow rates may not be equal to each other even with the same opening degree. In this case, as shown in FIG. 24, the refrigerant may be minutely adjusted to an arbitrary refrigerant flow rate by rotating the valve body in the adjustable area (an adjustable area B3 in FIG. 24) to continuously change the opening degree of the outlets in the plurality of output ports. For example, during the operation in step D of FIG. 24, (In this case, the refrigerant flow rate ratio of an R side: 20% to an F side: 80%) when the refrigerant flow rate ratio becomes the R side: 25% to the F side: 75% by a change in the freezer compartment load, the step is changed to step E by rotating the valve body, and thus the refrigerant flow rate ratio may be returned to an initial refrigerant flow rate ratio (the R side: 20% and the F side: 80%). Even when the refrigerant flow rate is changed by a change in the refrigerated compartment load, the opening degrees of the outlets in the plurality of output ports are continuously changed by rotating the valve body, and thus the refrigerant flow rate ratio may be minutely controlled to the predetermined refrigerant flow rate ratio.

Also, in the embodiment, the shapes of outlines of the portions that pass through the outlets P2*a* and P3*a* in each valve body 312 have a curved shape, but the shapes are not limited thereto. The shape may be straight or curved, or a combination shape thereof.

Fourth Embodiment

The fourth embodiment of the present invention will be described with reference to the drawings.

Figure 25:
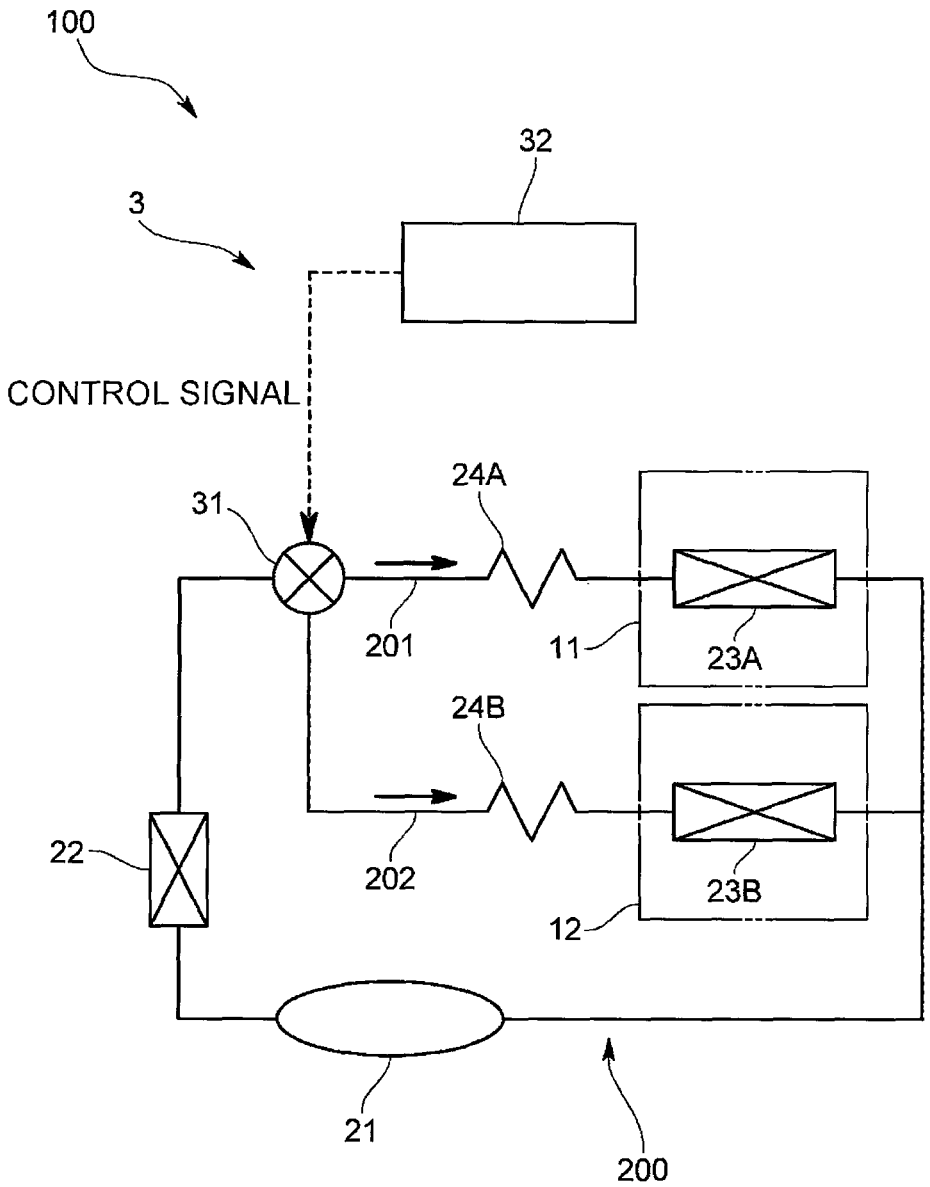
FIG. 25 is a schematic configuration diagram of a cooling device according to a fourth embodiment.

A cooling device 100 according to the fourth embodiment, as shown in FIG. 25, includes a refrigerated compartment 11, a freezer compartment 12, and a refrigeration circuit 200 including a compressor 21, a condenser 22 installed at an outlet side of the corresponding compressor 21, a refrigerated compartment evaporator 23A and a freezer compartment evaporator 23B installed between the outlet side of the corresponding condenser 22 and an inlet side of the compressor 21 and connected with each other in parallel, and a refrigerated compartment decompression means 24A, for example a capillary tube, installed in series at an inlet side of the refrigerated compartment evaporator 23A and a refrigerated compartment decompression means 24B, for example a capillary tube, installed in series at an inlet side of the freezer compartment evaporator 23B.

In this case, the refrigerated compartment evaporator 23A and the freezer compartment evaporator 23B are installed in two refrigerant branching passages 201 and 202 branched from the outlet side of the condenser 22, respectively. The refrigerated compartment evaporator 23A is installed to cool the inside of the refrigerated compartment 11, and the freezer compartment evaporator 23B is installed to cool the inside of the freezer compartment 12.

The cooling device 100 of the embodiment, as shown in FIG. 25, includes a refrigerant control unit 3 that individually controls the refrigerant flow rate that flows to the refrigerated compartment evaporator 23A and the freezer compartment evaporator 23B by adjusting the refrigerant flow rate that flows into each of the refrigerant branching passages 201 and 202.

The refrigerant control unit 3 includes a refrigerant control valve 31 controlling the refrigerant flow rate that flows to the refrigerated compartment evaporator 23A and the freezer compartment evaporator 23B and a control device 32 controlling the refrigerant control valve 31. Also, the control device 32 is a general or exclusive computer including a CPU, a memory, an input output interface, an AD converter and the like, and controls the refrigerant control valve 31 by enabling the CPU, peripheral devices, and the like to cooperate with each other according to a control program stored in a predetermined area of the memory.

The refrigerant control valve 31 of the embodiment is a 3-way valve installed at a branching point of the refrigerant branching passages 201 and 202. An input port is connected with a refrigerant tube on the side of the condenser 22, a first output port is connected with a branching tube configuring the refrigerant branching passage 201 on the side of the refrigerated compartment evaporator 23A, and a second output port is connected with a branching tube configuring the refrigerant branching passage 202 on the side of the freezer compartment evaporator 23B. The refrigerant control valve 31 individually controls the opening and closing of the first output port and the second output port using a control signal from the control device 32.

Figure 26:
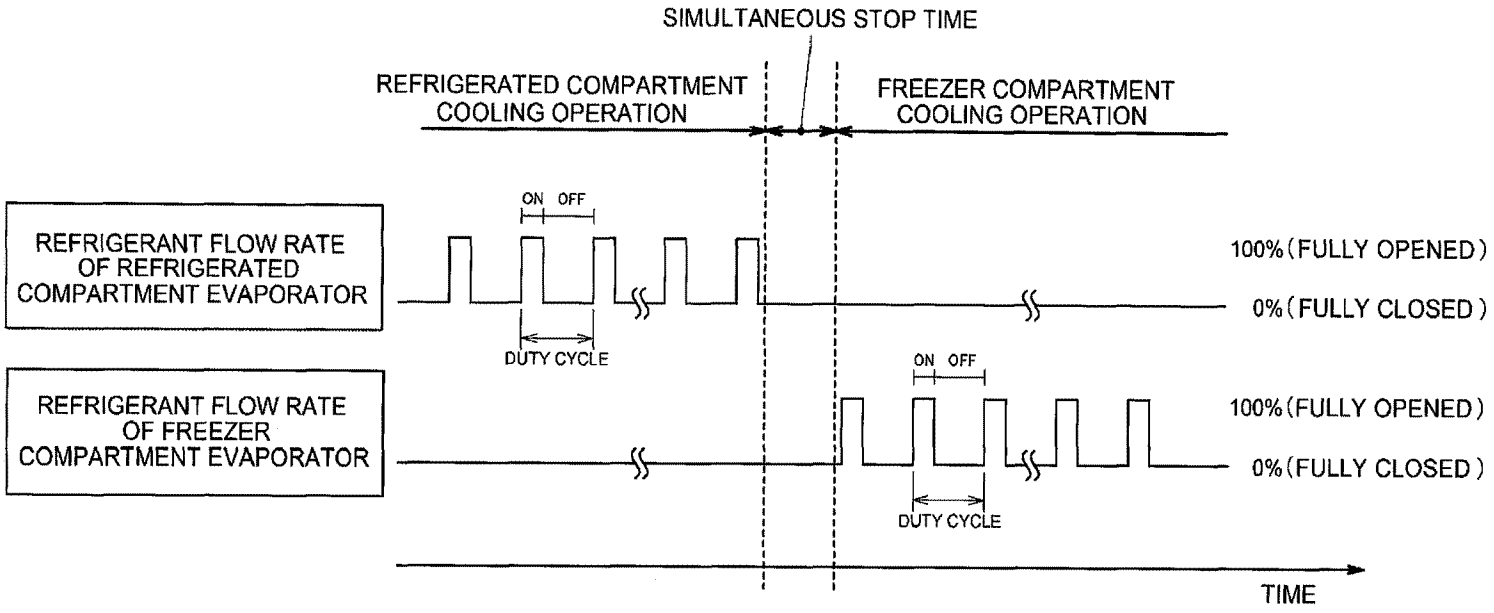
FIG. 26 is a view illustrating an opening operation pattern of a refrigerant control valve according to the fourth embodiment.

Hereinafter, an embodiment of an opening and closing operation pattern of the refrigerant control valve 31 according to the control device 32 will be described with reference to FIG. 26.

The control device 32 controls the refrigerant control valve 31 by sequentially performing a refrigerated compartment cooling operation of cooling the refrigerated compartment 11 and a freezer compartment cooling operation of cooling the freezer compartment 12, thereby selectively switching the evaporator that supplies a refrigerant between the refrigerated compartment evaporator 23A and the freezer compartment evaporator 23B. Also, in the embodiment, a simultaneous stop time period in which the refrigerant is not supplied to both sides of the evaporators 23A and 23B between the refrigerated compartment cooling operation and the freezer compartment cooling operation is set.

Specifically, the control device 32 intermittently supplies the refrigerant by turning the refrigerant control valve 31 ON/OFF after switching between evaporators supplying the refrigerant (when the refrigerated compartment cooling operation or the freezer compartment cooling operation is performed). For example, after the evaporator supplying the refrigerant is switched into the refrigerated compartment evaporator 23A, the refrigerant control valve 31 is turned ON/OFF to intermittently supply the refrigerant to the refrigerated compartment evaporator 23A. Also, after the evaporator supplying the refrigerant is switched into the freezer compartment evaporator 23B, the refrigerant control valve 31 is turned ON/OFF to intermittently supply the refrigerant to the corresponding freezer compartment evaporator 23B.

Here, the control device 32 performs duty control on the refrigerant control valve 31 and sets a cycle of the duty control from 3 to 200 seconds. Also, the control device 32 sets a time so that an ON-time of the refrigerant control valve 31 is longer than an OFF-time thereof in the duty control. The ON-time is a refrigerant supply time in which the refrigerant is supplied to the evaporator, and the OFF-time is a refrigerant collecting time in which the refrigerant (especially liquid refrigerant) is collected from the evaporator. Because of this, the refrigerant is certainly collected from the evaporator by setting the OFF-time to be longer than the ON-time. Also, the control device 32 sets a duty ratio (a time ratio) to control overheating by stabilizing a difference between an inlet temperature of the evaporator and an outlet temperature thereof between, for example, 0 to 10° C. Also, a cycle and the duty ratio in the duty control when the refrigerant is supplied to the refrigerated compartment evaporator 23A are the same as or different from a cycle and a duty ratio in the duty control when the refrigerant is supplied to the freezer compartment evaporator 23B.

According to the cooling device 100 configured above, after the evaporator supplying the refrigerant is switched to any one side of the refrigerated compartment evaporator 23A or the freezer compartment evaporator 23B, the refrigerant is intermittently supplied by turning the refrigerant control valve 31 ON/OFF, thereby reducing a pressure loss generated by a liquid refrigerant in any one side of the corresponding refrigerated compartment evaporator 23A or the freezer compartment evaporator 23B, and suppressing an increase in the evaporator temperature. Therefore, it is possible to prevent heat exchange performance of the refrigerated compartment evaporator 23A and the freezer compartment evaporator 23B from being degraded, prevent cooling efficiency from being degrading, and perform an energy saving operation. Also, the cooling time of the cooling chamber becomes appropriate, and the temperature quality of the cooling chamber is increased. Also, the possibility of liquid back-flowing to the compressor is reduced, and the durability of the compressor is improved.

Also, when the control device 32 performs duty control on the refrigerant control valve 31, the ON-time in the refrigerant control valve 31 is set to be longer than the OFF-time, and thus the liquid refrigerant may be certainly collected from the evaporator supplying the refrigerant.

Modification of Fourth Embodiment

The present invention is not limited to the fourth embodiment.

Figure 27:
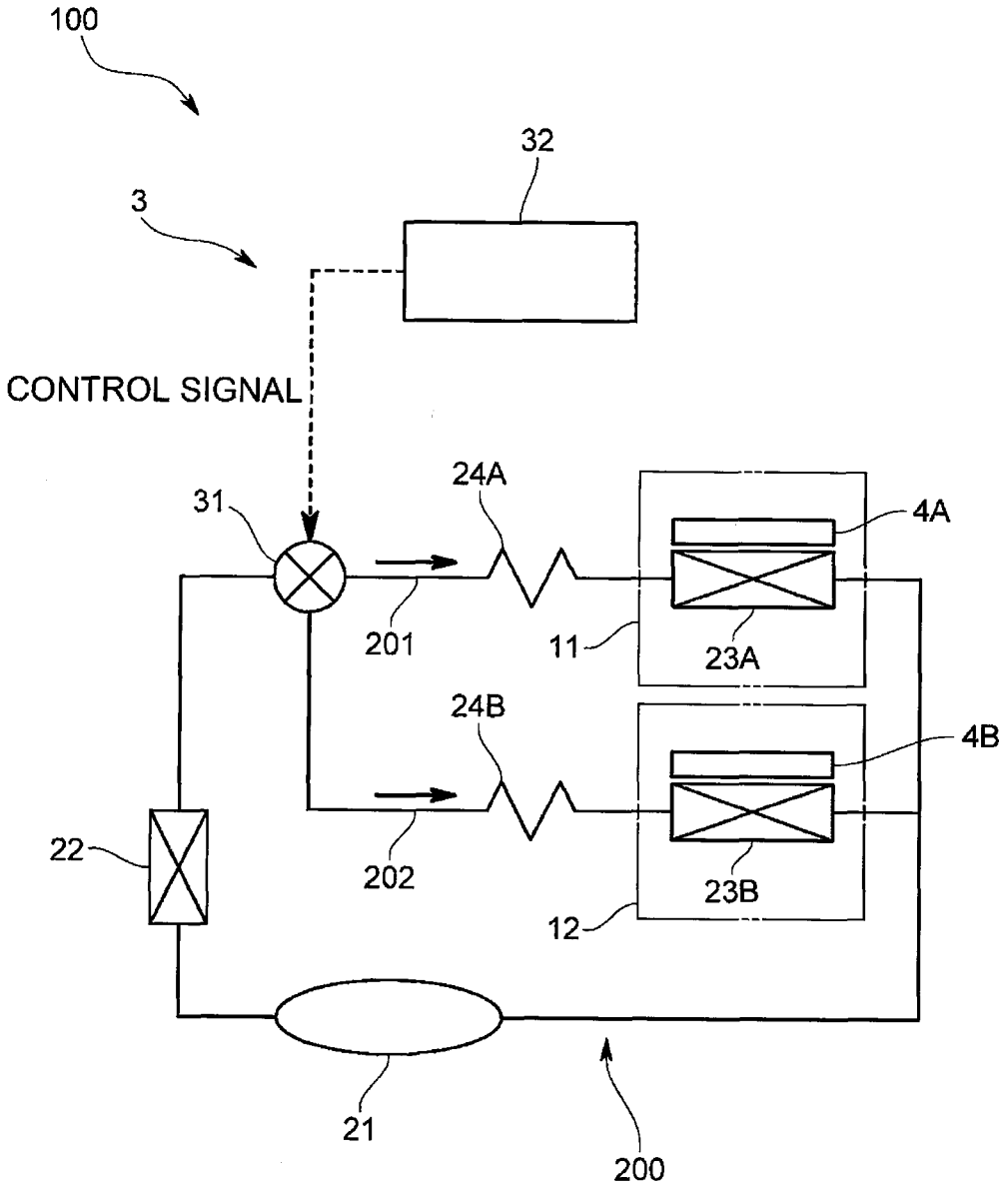
FIG. 27 is a schematic configuration view of a cooling device according to a modification of the fourth embodiment.
Figure 28:
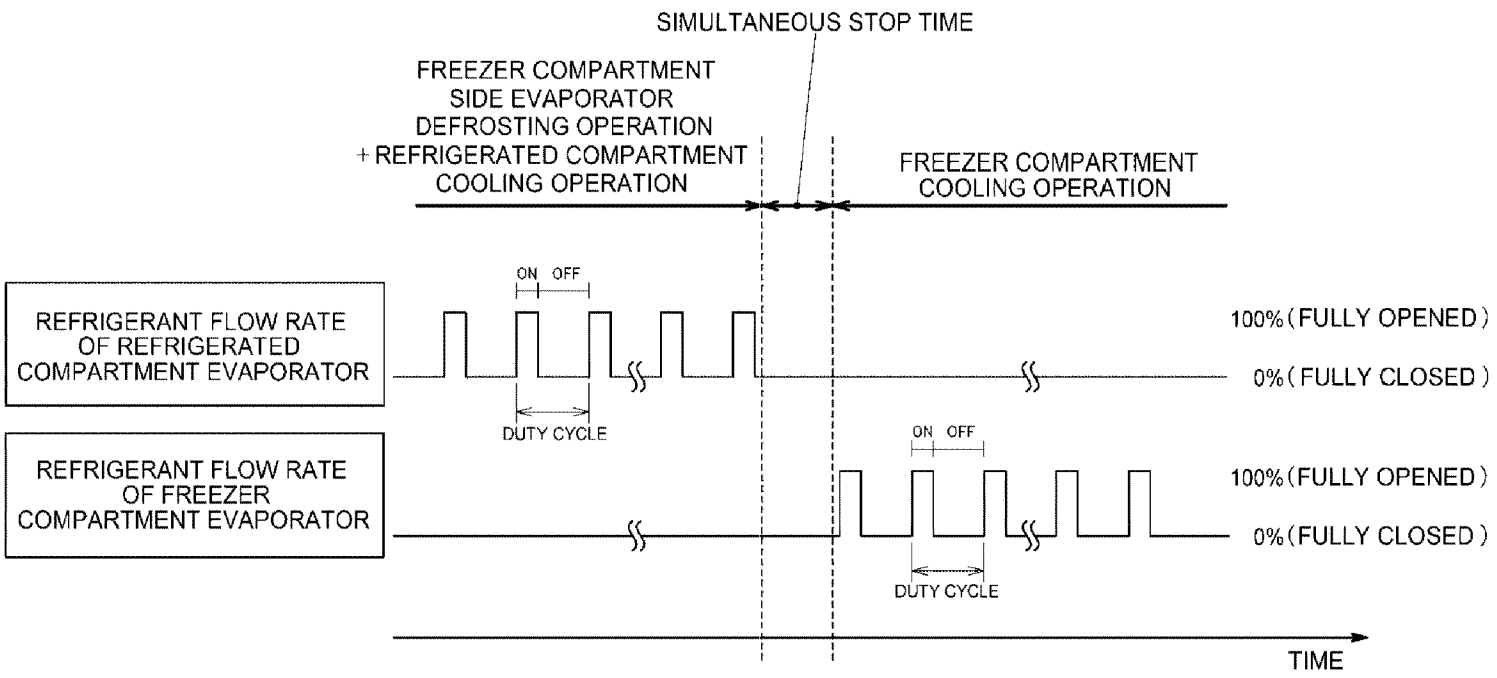
FIG. 28 is a view illustrating an opening operation pattern of a refrigerant control valve according to the modification of the fourth embodiment.
Figure 29:
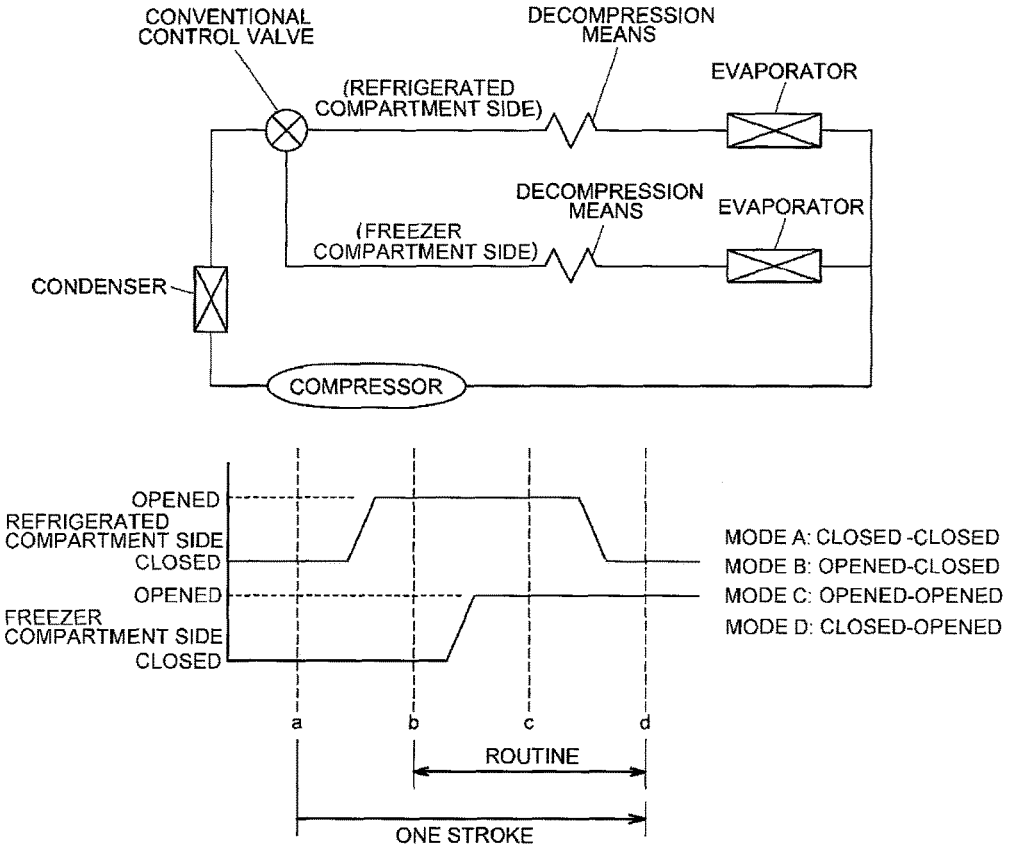
FIG. 29 is a view illustrating an operation pattern of a conventional refrigerant control valve.

For example, as shown in FIG. 27, the cooling device 100 may include defrosters 4A and 4B, for example a heater and the like, to remove frost from each of the refrigerated compartment evaporator 23A and the freezer compartment evaporator 23B. In this case, while frost is removed from one evaporator (for example, the freezer compartment evaporator 23B) by the defroster 4B, the refrigerant is supplied by the refrigerant control unit 3 to the evaporator (for example, refrigerated compartment evaporator 23A) from which the frost is not removed. Here, the control device 32 of the refrigerant control unit 3 intermittently supplies the refrigerant to one evaporator (for example, the refrigerated compartment evaporator) by turning the refrigerant control valve 31 ON/OFF. The opening and closing operation pattern of the refrigerant control valve 31 appears as shown in FIG. 28.

Therefore, while frost is removed from the one side of the evaporators 23A and 23B by the defrosters 4A and 4B, the refrigerant control unit 3 intermittently supplies the refrigerant to an evaporator from which the frost is not removed by turning the refrigerant control valve 31 ON/OFF, thereby reducing a pressure loss generated by a liquid refrigerant in the corresponding evaporators 23A and 23B and suppressing an increase in the evaporator temperature. Therefore, the heat exchange performance of the evaporators 23A and 23B can be prevent from being degraded and an energy saving operation can be performed.

Also, the control device 32 is installed outside the cooling device 100 to obtain a detected temperature from an external air temperature sensor detecting an external air temperature (an ambient temperature) so that the time ratio (the duty ratio) varies between the ON time and the OFF time of the refrigerant control valve 31 depending on the ambient temperature.

Hereinabove, the present invention is not limited to each embodiment, and configurations described in each embodiment may be combined and variously modified without departing from the spirit and the scope of the present invention.

The invention claimed is:

1. A cooling device comprising:

a cooling chamber;

a refrigeration circuit that includes a compressor, a condenser installed at an outlet side of the compressor, an evaporator installed between an outlet side of the condenser and an inlet side of the compressor to cool the cooling chamber, and a capillary tube installed at an inlet side of the evaporator; and a refrigerant control unit that includes a refrigerant control valve installed between the condenser and the evaporator and is configured to control a fully opening and closing time of the refrigerant control valve and to sequentially change a refrigerant flow rate that flows to the evaporator and another evaporator.

2. The cooling device of claim 1, wherein the refrigerant control unit is further configured to perform a duty control on the refrigerant control valve.

3. The cooling device of claim 2, wherein a cycle of the duty control is set from 3 to 200 seconds.

4. The cooling device of claim 2, wherein an ON time of the refrigerant control valve is set to be longer than an OFF time thereof in the duty control.

5. The cooling device of claim 2, wherein the refrigerant control unit is further configured to set a duty ratio so that a difference between an inlet temperature and an outlet temperature of the evaporator is uniform in the duty control.

6. The cooling device of claim 1, wherein an OFF time is set to be longer than an ON time during a refrigerant control valve operation.

7. The cooling device of claim 1, wherein the refrigerant control unit is further configured to perform variable controls on a time ratio of an ON time of the refrigerant control valve to an OFF time thereof depending on an ambient temperature.

8. The cooling device of claim 1, wherein a check valve is installed between the evaporator and the compressor to prevent refrigerant from back-flowing.

9. The cooling device of claim 1, wherein the refrigerant control valve is configured to repeat an opening and closing routine, in which a plurality of opening and closing selective modes having a combination of an opening valve state in which refrigerant flows to each of a plurality of evaporators and a closing valve state in which the refrigerant does not flow thereto are sequentially switched between several times during one stroke of a valve body.

10. A cooling device comprising:

a plurality of cooling chambers having temperatures different from each other;

a refrigeration circuit that includes a compressor, a condenser installed at an outlet side of the compressor, a plurality of evaporators connected in parallel between an outlet side of the condenser and an inlet side of the compressor and respectively installed to correspond to the plurality of cooling chambers, and a plurality of capillary tubes respectively installed at inlet sides of the evaporators; and a refrigerant control unit that includes a refrigerant control valve which is installed between the condenser and the plurality of evaporators and configured to:

control a refrigerant flow rate that flows into each of the evaporators and individually controls a ratio of refrigerants that flow to the respective evaporators by controlling a fully opening and closing time of the refrigerant control valve during a simultaneous cooling operation of simultaneously cooling the plurality of cooling chambers; and sequentially change the refrigerant flow rate that flows into the evaporators.

11. The cooling device of claim 10, wherein the refrigerant control unit is further configured to alternately perform a refrigerant full outflow period in which the refrigerant flows to all of the plurality of evaporators and a refrigerant partial outflow period in which the refrigerant flows to some of the plurality of evaporators by controlling the fully opening and closing time of the refrigerant control valve.

12. The cooling device of claim 10, wherein the refrigerant control unit is further configured to perform a duty control on the refrigerant control valve.

13. The cooling device of claim 10, wherein the refrigerant control valve is further configured to repeat an opening and closing routine, in which a plurality of opening and closing selective modes having a combination of an opened valve state in which the refrigerant flows to each of the plurality of evaporators and a closed valve state in which the refrigerant does not flow thereto are sequentially switched between several times during one stroke of a valve body.

14. A cooling device comprising:

a plurality of cooling chambers having temperatures different from each other;

a refrigerant circuit that includes a compressor, a condenser installed at an outlet side of the compressor, a plurality of evaporators connected in parallel between an outlet side of the condenser and an inlet side of the compressor and respectively installed to correspond to the plurality of cooling chambers, and a plurality of capillary tubes respectively installed at inlet sides of the evaporators; and a refrigerant control unit that includes a refrigerant control valve installed between the condenser and the plurality of evaporators to selectively switch an evaporator supplying a refrigerant among the plurality of evaporators and to sequentially change the refrigerant flow rate that flows into the plurality of evaporators, wherein the refrigerant control unit is configured to control a refrigerant flow rate that flows into the evaporator supplying the refrigerant after switching to the evaporator by controlling an opening and closing time of the refrigerant control valve.

15. A cooling device comprising:

a plurality of cooling chambers having temperatures different from each other;

a refrigerant circuit that includes a compressor, a condenser installed at an outlet side of the compressor, a plurality of evaporators connected in parallel between an outlet side of the condenser and an inlet side of the compressor and respectively installed to correspond to the plurality of cooling chambers, and a plurality of capillary tubes respectively installed at inlet sides of the evaporators;

a refrigerant control unit including a refrigerant control valve installed between the condenser and the plurality of evaporators to selectively switch an evaporator supplying a refrigerant among the plurality of evaporators and to sequentially change the refrigerant flow rate that flows into the plurality of evaporators; and a defroster configured to remove frost from any one of the plurality of evaporators, wherein the refrigerant control unit is configured to control a refrigerant flow rate that flows to an evaporator from which the frost is not removed when frost is removed from any one of the plurality of evaporators by the defroster by controlling an opening and closing time of the refrigerant control valve.

16. A cooling device comprising:

a plurality of cooling chambers having temperatures different from each other;

a refrigerant circuit that includes a compressor, a condenser installed at an outlet side of the compressor, a plurality of evaporators connected in parallel between an outlet side of the condenser and an inlet side of the compressor and respectively installed to correspond to the plurality of cooling chambers, and a plurality of capillary tubes respectively installed at inlet sides of the evaporators; and a refrigerant control unit that includes a refrigerant control valve installed between the condenser and the plurality of evaporators to control a refrigerant flow rate that flows into each of the evaporators and sequentially changes the refrigerant flow rate that flows into the plurality of evaporators.

17. The cooling device of claim 16, wherein the refrigerant control unit is further configured to change the refrigerant flow rate that flows to each of the evaporators at change rates different from each other.

18. The cooling device of claim 16, wherein the refrigerant control valve includes a valve main body having an input port connected to the outlet side of the condenser and a plurality of output ports respectively connected to the inlet sides of the plurality of evaporators, and a valve body installed to correspond to each of the plurality of the output ports in the valve main body and opening and closing outlets connected to the output ports, wherein a total of opening degrees of the outlets in the plurality of output ports is less than 100%.

19. The cooling device of claim 18, wherein the valve body has a fully closed state in which the plurality of output ports are simultaneously closed.

20. The cooling device of claim 18, wherein the refrigerant control unit is further configured to sequentially change the opening degree of the outlets in the plurality of output ports depending on a change in a load of each of the cooling chambers.

* * * * *